US009802799B2

(12) United States Patent
Ishikawa et al.

(10) Patent No.: US 9,802,799 B2
(45) Date of Patent: Oct. 31, 2017

(54) CHAIN BLOCK

(71) Applicant: KITO CORPORATION, Nakakoma-gun, Yamanashi (JP)

(72) Inventors: Kazumitsu Ishikawa, Yamanashi (JP); Hiroki Sano, Yamanashi (JP); Kosuke Kosuga, Yamanashi (JP)

(73) Assignee: KITO CORPORATION, Nakakoma-Gun, Yamanashi (JP)

( * ) Notice: Subject to any disclaimer, the term of this patent is extended or adjusted under 35 U.S.C. 154(b) by 0 days.

(21) Appl. No.: 14/413,345

(22) PCT Filed: Jul. 29, 2013

(86) PCT No.: PCT/JP2013/070458
§ 371 (c)(1),
(2) Date: Jan. 7, 2015

(87) PCT Pub. No.: WO2014/021255
PCT Pub. Date: Feb. 6, 2014

(65) Prior Publication Data

US 2015/0166312 A1 Jun. 18, 2015

(30) Foreign Application Priority Data

Jul. 30, 2012 (JP) ..... 2012-168498

(51) Int. Cl.
*B66D 3/16* (2006.01)
*B66D 3/26* (2006.01)

(52) U.S. Cl.
CPC *B66D 3/16* (2013.01); *B66D 3/26* (2013.01)

(58) Field of Classification Search
CPC ..... B66D 3/16; B66D 3/26
See application file for complete search history.

(56) References Cited

U.S. PATENT DOCUMENTS 2,256,296 A * 9/1941 Smith ..... B66D 3/16 184/105.3
3,894,720 A * 7/1975 Koji ..... B66D 3/16 254/285

(Continued)

FOREIGN PATENT DOCUMENTS

JP 61-171796 U 10/1986
JP 3015809 U 9/1995

(Continued)

OTHER PUBLICATIONS

International Search Report Corresponding to International Application No. PCT/JP2013/070458; dated Oct. 8, 2013.

(Continued)

*Primary Examiner* — Emmanuel M Marcelo
*Assistant Examiner* — Michael Gallion
(74) *Attorney, Agent, or Firm* — Cantor Colburn LLP

(57) ABSTRACT

Provided is a chain block with which wheel cover strength can be improved while inhibiting an increase in cost, without the need for separate reinforcement members. A chain block is provided with a wheel cover which is attached to a frame member, and which covers a hand-chain wheel having a hand chain looped thereover. A plurality of fixation holes for having fixation members inserted therethrough during attachment to the frame member are provided in peripheral edge sections of end-surface sides of the wheel cover, said end-surface sides being disposed facing the frame member. Wrap-around portions are provided to wheel-cover side surfaces which intersect the end surfaces, said wrap-around portions being formed so as to surround, at an angle exceeding 90, the fixation holes in the peripheral direction of the fixation holes.

10 Claims, 20 Drawing Sheets

(56) References Cited

U.S. PATENT DOCUMENTS

| | | | | | |
|---|---|---|---|---|---|
| 5,007,617 | A * | 4/1991 | Nishimura | B66D 3/14 | 254/358 |
| 5,125,629 | A * | 6/1992 | Nishimura | B66D 3/16 | 254/358 |
| 5,472,171 | A * | 12/1995 | Nishi | B66D 3/14 | 254/352 |
| 5,566,925 | A * | 10/1996 | Wada | B66D 3/16 | 254/358 |
| 6,007,054 | A * | 12/1999 | Kobayasi | B66D 3/26 | 254/346 |
| 6,032,928 | A * | 3/2000 | Okamoto | B66D 3/16 | 254/372 |
| 6,224,039 | B1 * | 5/2001 | Okamoto | B66D 3/16 | 254/346 |
| 6,450,482 | B1 * | 9/2002 | Struck | B66D 3/26 | 254/358 |
| 7,344,121 | B1 * | 3/2008 | Pan | B66D 1/58 | 254/346 |
| 7,441,748 | B2 * | 10/2008 | Sakai | B66D 3/16 | 254/342 |
| 9,016,666 | B2 * | 4/2015 | Xia | B66D 3/16 | 254/273 |
| 9,051,160 | B2 * | 6/2015 | Zheng | B66D 1/14 | |
| 2002/0030182 | A1 * | 3/2002 | Struck | B66D 3/16 | 254/372 |
| 2002/0121633 | A1 * | 9/2002 | Fujikawa | B66D 3/14 | 254/358 |
| 2003/0102397 | A1 * | 6/2003 | Chambers | B66D 1/72 | 242/372 |
| 2015/0166312 | A1 * | 6/2015 | Ishikawa | B66D 3/16 | 254/383 |
| 2015/0191335 | A1 * | 7/2015 | Ishikawa | B66D 3/16 | 254/342 |
| 2015/0298946 | A1 * | 10/2015 | Kosuga | B66D 3/16 | 254/342 |
| 2015/0314998 | A1 * | 11/2015 | Ishikawa | B66D 3/16 | 254/358 |

FOREIGN PATENT DOCUMENTS

| | | | |
|---|---|---|---|
| JP | 9-40376 | A | 2/1997 |
| JP | 2000-211892 | A | 8/2000 |
| JP | 2011-201637 | A | 10/2011 |
| KR | 20-0343528 | A | 3/2004 |
| RU | 19286 | U1 | 8/2001 |
| SU | 800121 | A1 | 1/1981 |
| WO | 2011118666 | A1 | 9/2011 |

OTHER PUBLICATIONS

Russian Office Action corresponding to Application No. 2015105252/(008309); dated Mar. 22, 2016, with English translation.

Korean Office Action corresponding to Application No. 10-2017-7003738; dated May 8, 2017.

* cited by examiner

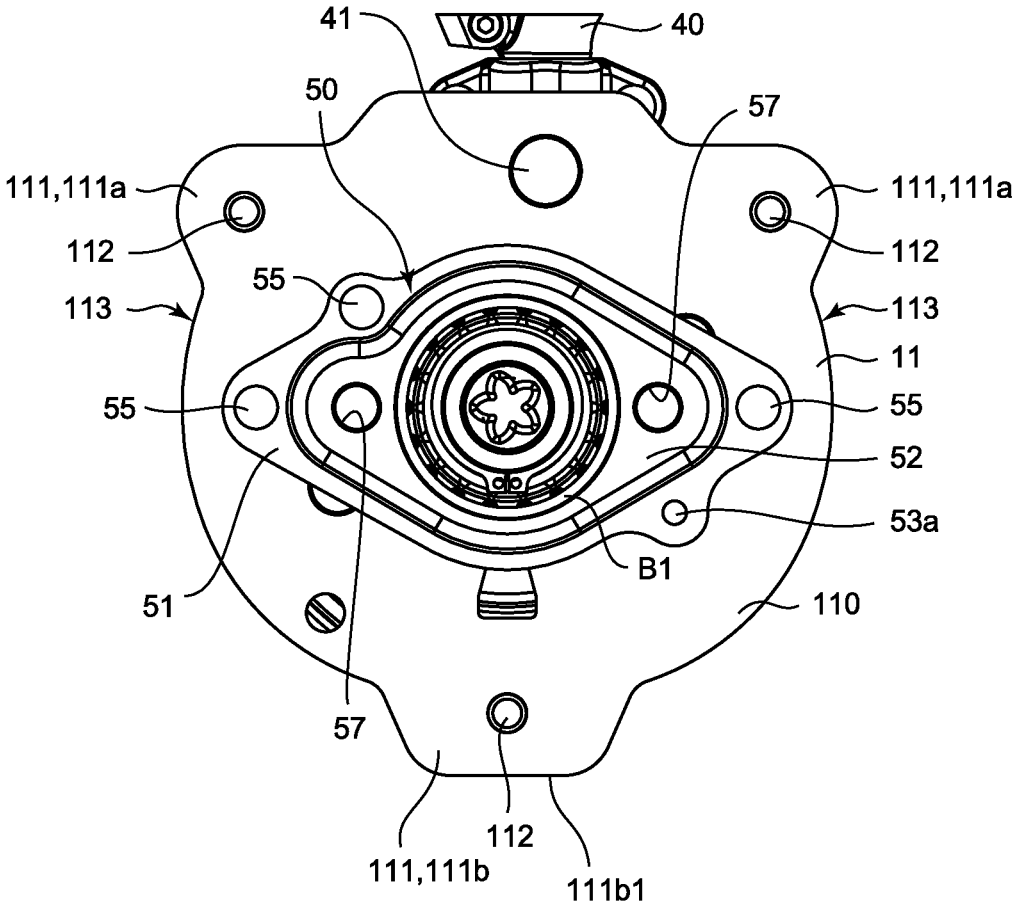
Fig.6
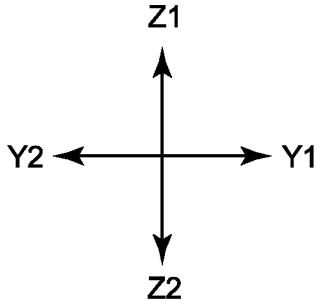

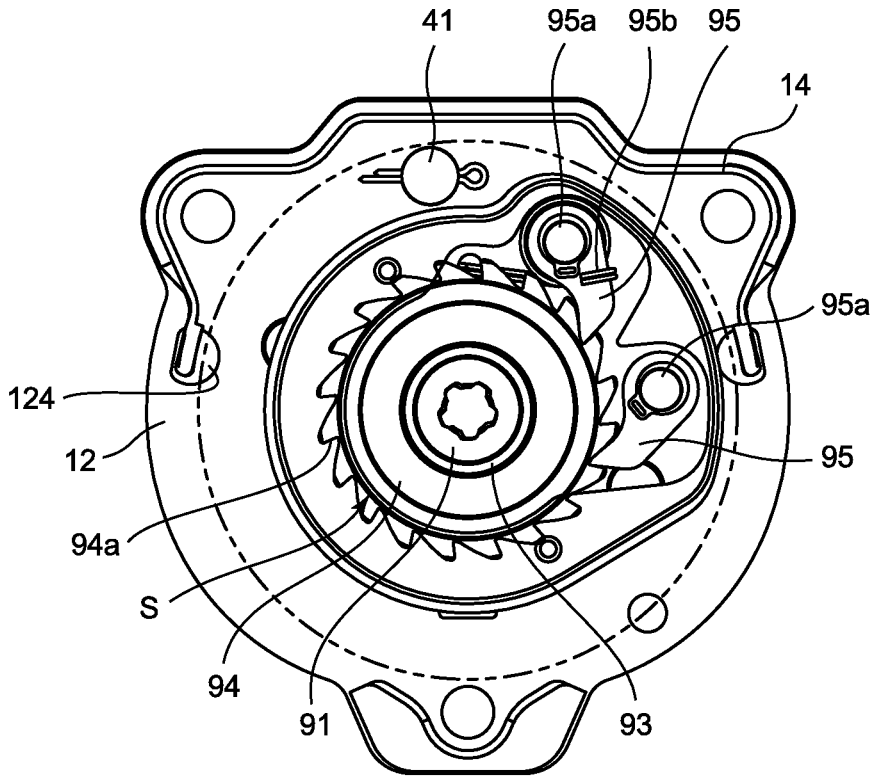
Fig.14
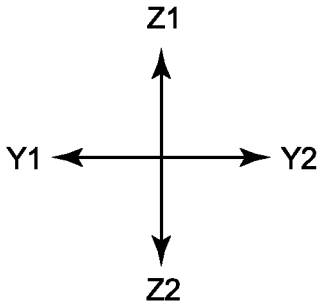

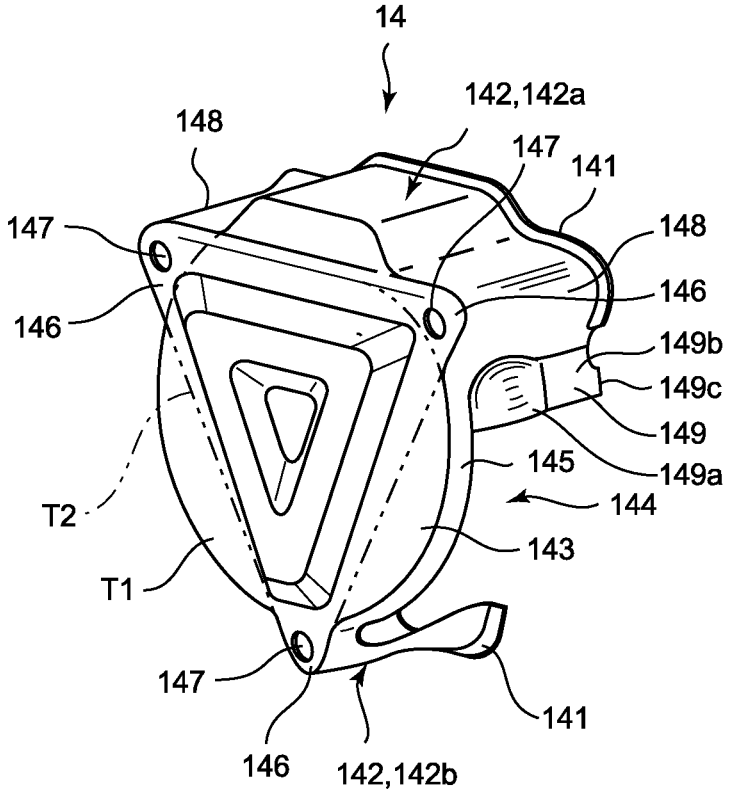
Fig.15
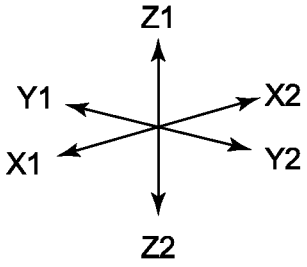

CHAIN BLOCK

CROSS REFERENCE TO RELATED APPLICATIONS

This is the U.S. national stage of application No. PCT/JP2013/070458, filed on Jul. 29, 2013. Priority under 35 U.S.C. §119(a) and 35 U.S.C. §365(b) is claimed from Japanese Application No. 2012-168498, filed Jul. 30, 2012, the disclosure of which is also incorporated herein by reference.

TECHNICAL FIELD

The present invention relates to a chain block for use in a load hoisting work.

BACKGROUND ART

In order to move a load in an up-down direction, a chain block is generally used. The chain block includes a hand wheel, a wheel cover, a main body portion, and the like. The main body portion is provided with a load sheave around which a load chain is wound. Then, when a hand chain wound around the hand wheel is wound up, the hand wheel rotates, and the rotation of the hand wheel is transmitted to the load sheave through a predetermined transmission mechanism including gears and the like. Thereby, the load hung on a lower hook are moved in an upward direction. Conversely, when the hand chain is wound down in a state where the load is positioned in the upper side, the load is moved in a downward direction. Such a chain block is disclosed in, for example, Patent Literature 1.

In the chain block described in Patent Literature 1, a wheel cover (refer to FIG. 19) is mounted to a second main frame, but the wheel cover is provided in a shape following the contours of a first main frame and the second main frame.

CITATION LIST

Patent Literature

[PLT 1] Japanese Patent Laid-open Publication No. 2011-201637

SUMMARY OF INVENTION

Technical Problem

Now, in order to resist impact or external force acting on a wheel cover, there is a need to improve the strength of the wheel cover. However, in a case where the thickness of a steel plate is increased, a separate reinforcement member is added, or additional work is required so as to improve the strength of the wheel cover, a cost is increased accordingly. Thus, there is a need to improve the strength of the wheel cover while suppressing an increase in weight or cost with no need for a separate reinforcement member.

Solution to Problem

The present invention has been made under the above-described circumstances, and an object of the present invention is to provide a chain block with which the strength of a wheel cover can be improved while suppressing an increase in weight or cost with no need to increase the thickness of a steel plate nor need for a separate reinforcement member.

Advantageous Effects of Invention

In order to solve the above-described problem, according to a first aspect of the present invention, is provided a chain block including a wheel cover that is mounted to a frame member and covers a hand wheel over which a hand chain is wound, wherein a plurality of fixation holes into which fixation members are inserted during mounting to the frame member is provided in a peripheral edge portion on an end surface side arranged facing the frame member of the wheel cover, and a wrap-around portion formed surrounding a fixation hole at an angle exceeding 90 degrees in a peripheral direction of the fixation hole is provided in a side surface of the wheel cover, which intersects the end surface.

Furthermore, according to another aspect of the present invention, it is preferable that in the above-described invention the wheel cover be provided with a chain guide portion that prevents the hand chain looped over the hand wheel from coming off, and the chain guide portion be provided adjacent to the wrap-around portion, and integrally provided in a continuous state with the wrap-around portion.

Further, according to another aspect of the present invention, it is preferable that in the above-described invention the wheel cover be provided with a chain guide portion that prevents the hand chain looped over the hand wheel from coming off, and the chain guide portion be provided adjacent to the wrap-around portion, and provided separately from the wrap-around portion without being continuous with the wrap-around portion.

Furthermore, according to another aspect of the present invention, it is preferable that in the above-described invention an outer peripheral edge portion of the frame member be provided with at least a pair of concave portions passing through a center side thereof with a drooping direction interposed therebetween, the drooping direction be a direction in which the hand chain droops when used, and the pair of concave portions be recessed toward the center side of the frame member more than the outer peripheral edge portion of the frame member adjacent to the concave portions.

Further, according to another aspect of the present invention, it is preferable that in the above-described invention a tip side spaced apart from the end surface of the chain guide portion be provided with a protruding tip that is inserted into an insertion hole of the frame member.

Furthermore, according to another aspect of the present invention, it is preferable that in the above-described invention an outer edge portion on a side spaced apart from the wrap-around portion of the chain guide portion be provided with a folded-back portion formed by hemming processing.

Advantageous Effects of Invention

According to the present invention, the strength of a wheel cover can be improved while suppressing an increase in weight or cost with no need to increase the thickness of a steel plate in a chain block nor need for a separate reinforcement member.

BRIEF DESCRIPTION OF DRAWINGS

FIG. 6 is a front view illustrating the shapes of a first frame and an auxiliary plate in a state where a reduction gear member and a load gear are removed from the chain block in FIG. 1.

FIG. 14 is a diagram illustrating an arrangement of a ratchet wheel and pawl members in the chain block in FIG. 1.

FIG. 15 is a perspective view illustrating the shape of a wheel cover in the chain block in FIG. 1.

DESCRIPTION OF EMBODIMENTS

Figure 1:
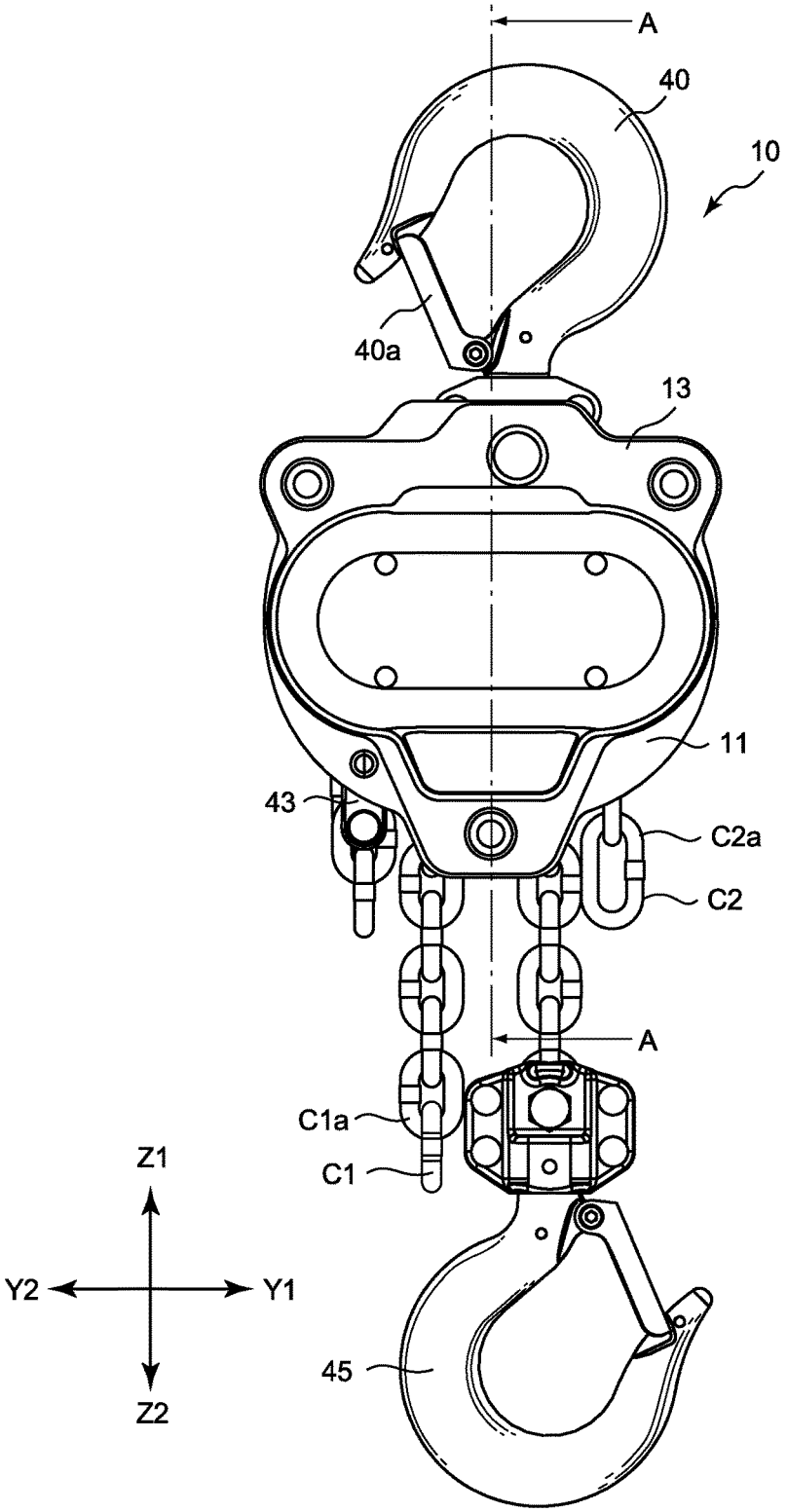
FIG. 1 is a front view illustrating an appearance of a chain block according to an embodiment of the present invention.

Hereinafter, a chain block 10 according to an embodiment of the present invention will be described with reference to the drawings.

<1. Regarding Configuration of Chain Block>

As illustrated in FIGS. 1 to 5 and the like, the chain block 10 includes a first frame 11, a second frame 12, a gear case 13, a wheel cover 14, a load-sheave hollow shaft 20, and a speed reducing mechanism 30, and these are fixed via stud bolts SB (corresponding to a fixation member) and nuts N. Then, between the first and second frames 11 and 12, between the first frame 11 and the gear case 13, and between the second frame 12 and the wheel cover 14, respective members are mounted; however, a part of the members protrude from therebetween. Hereinafter, the respective members will be described.

Figure 4:
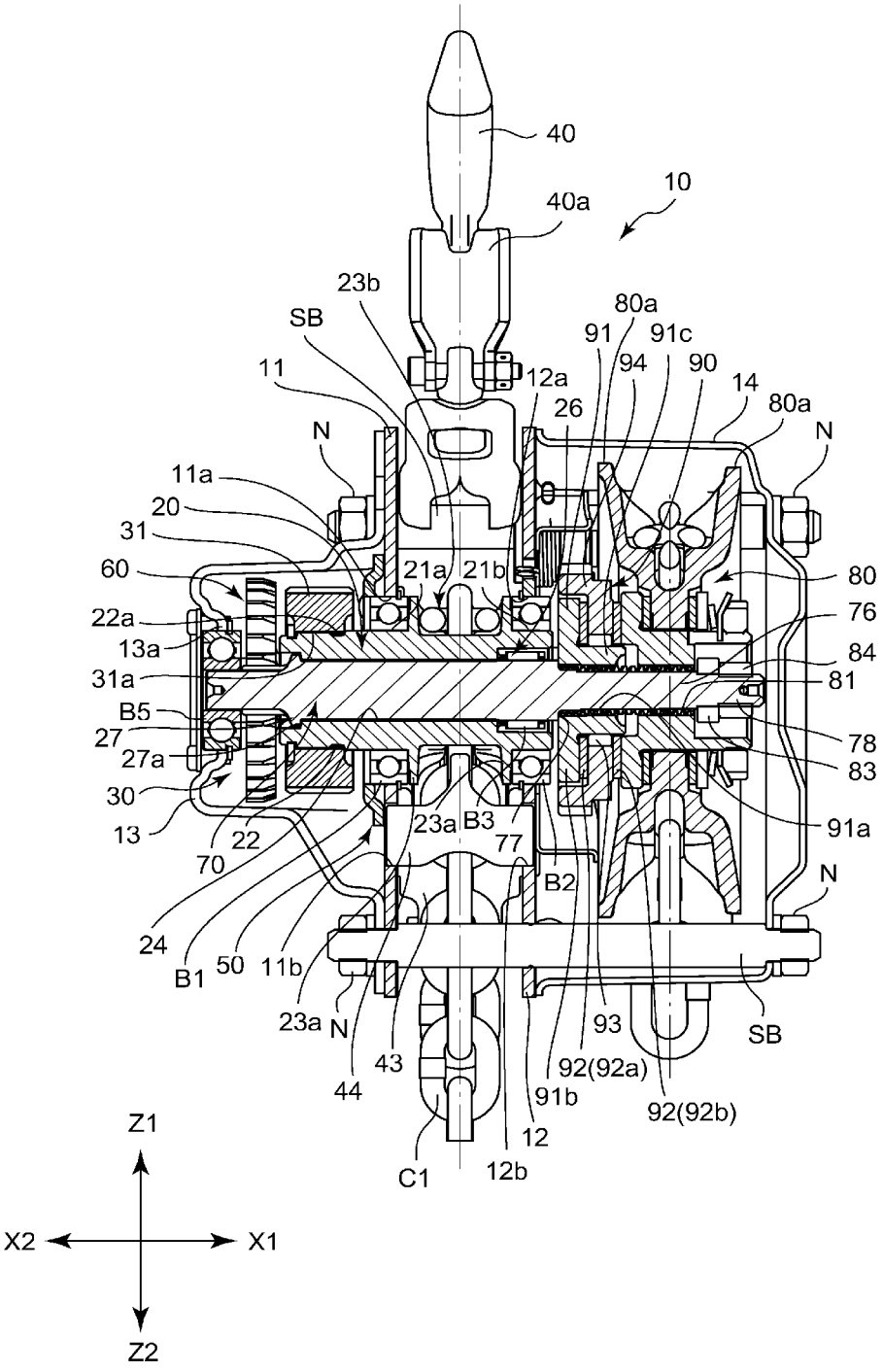
FIG. 4 is a side cross-sectional view illustrating a state in which the chain block has been cut along the line A-A in FIG. 1.
Figure 5:
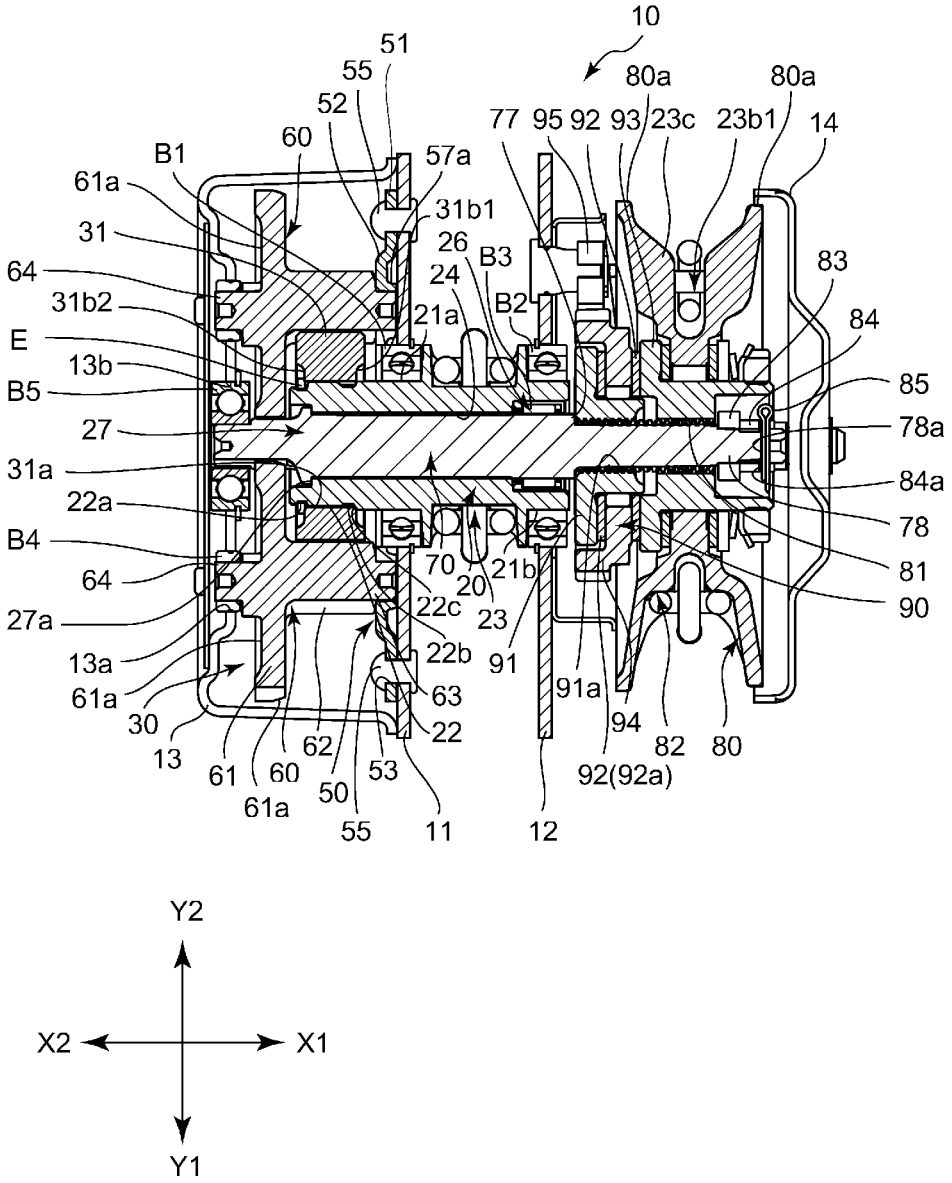
FIG. 5 is a side cross-sectional view illustrating a state in which the chain block has been cut along the line B-B in FIG. 2.

Between the first and second frames 11 and 12, a part of the load-sheave hollow shaft 20, an upper hook 40, a guide roller 42, a metal fastener 43, a stripper 44, and the like are positioned. As illustrated in FIGS. 4 and 5, the load-sheave hollow shaft 20 is supported by the first and second frames 11 and 12 through bearings B1 and B2 such as ball bearings, which are fitted into insertion holes 11*a* and 12*a* of the first and second frames 11 and 12, respectively. That is, the bearings B1 and B2 are positioned in outer peripheries of bearing fitting portions 21*a* and 21*b* of the load-sheave hollow shaft 20, and further the bearings B1 and B2 are positioned in the insertion holes 11*a* and 12*a*. Thereby, the load-sheave hollow shaft 20 is supported by the first and second frames 11 and 12.

Figure 9:
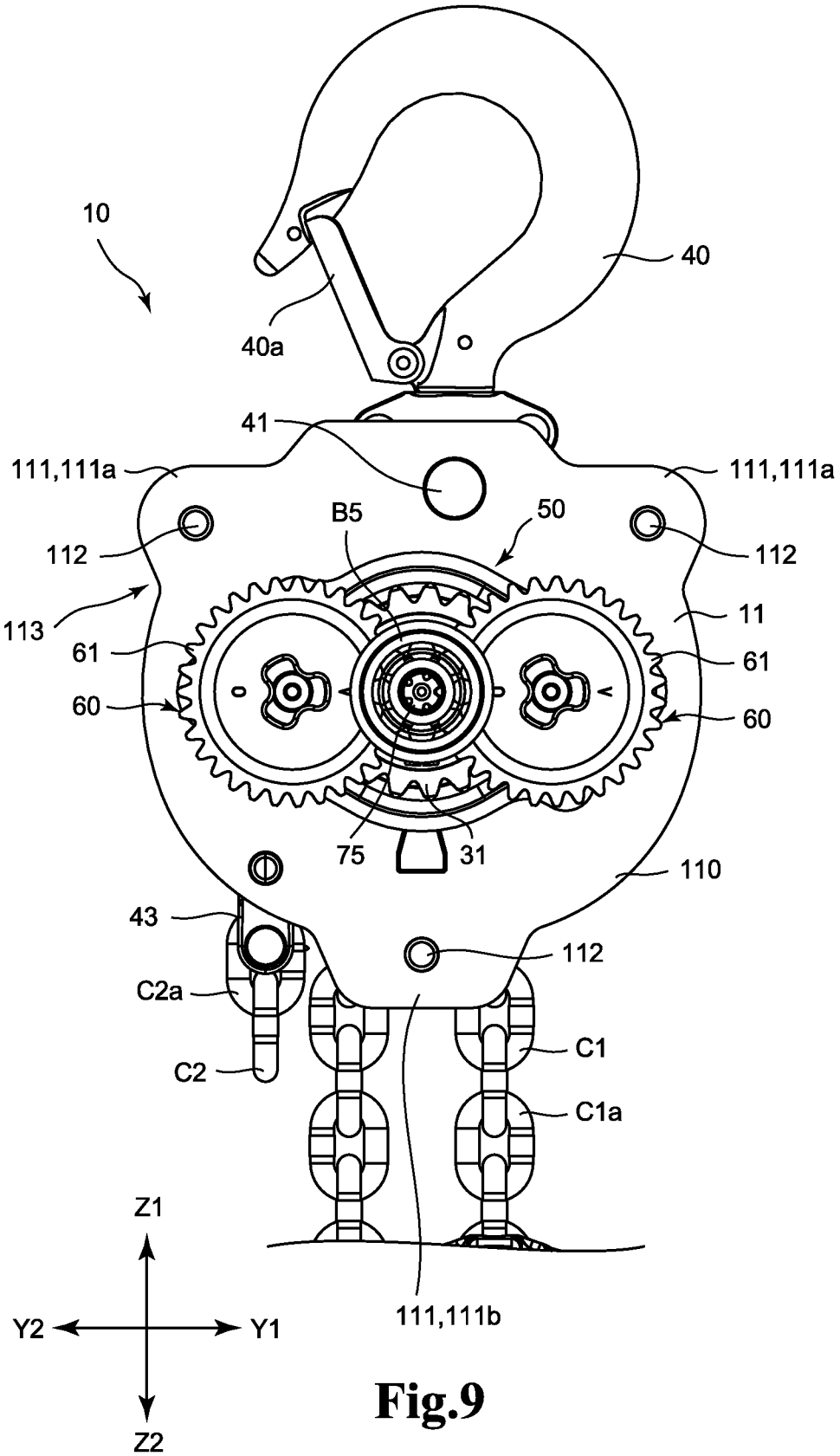
FIG. 9 is a diagram illustrating an arrangement of a reduction gear member and a load gear with respect to the first frame in the chain block in FIG. 1.

As illustrated in FIGS. 6 and 9, the first frame 11 has a circular portion 110 having a circular contour and a frame protruding portion 111 protruding from the circular portion 110. Total three frame protruding portions 111, two frame protruding portions on the upper side (Z1 side) and one frame protruding portion on the lower side (Z2 side) are provided. Furthermore, each of the frame protruding portions 111 is provided with an insertion hole 112 into which the stud bolt SB is inserted. Then, insertion holes are provided in such a manner that when the total three insertion holes 112 are connected to each other, an isosceles triangle is formed; however, the insertion holes may be provided in such a manner that an equilateral triangle or an approximately equilateral triangle is formed. Furthermore, the insertion holes may be provided in such a manner that when the total three insertion holes 112 are connected to each other, other triangle shapes than the isosceles triangle shape are formed.

As illustrated in FIGS. 6 and 9, a pair of frame protruding portions 111*a* positioned on the upper side (Z1 side) among the above-described frame protruding portions 111 are arranged along the Y direction. Then, a concave portion 113 is formed by a site on the lower side (Z2 side) of an outer peripheral edge portion of each of the pair of the frame protruding portions 111*a* and an outer peripheral edge portion of the circular portion. The concave portion 113 serves as a portion that reduces the width dimension of the first frame 11 between the circular portion 110 and the side of the lower side (Z2 side) of a frame protruding portion 111*a*. Thus, the chain block 10 can be grasped by, for example, positioning different fingers or the like in a pair of concave portions 113, respectively. That is, the chain block 10 can be grasped or held by the concave portion 113, in addition to the upper hook 40. Note that a separate grasping member or holding member can be positioned in each of the pair of concave portions 113 instead of fingers to grasp or hold the chain block 10 for the purpose of carrying and storing or packing.

Note that the frame protruding portion 111 existing on the lower side (Z2 side) is referred to as a frame protruding portion 111*b*, as necessary. An end surface on the Z2 side of the frame protruding portion 111*b* is a flat portion 111*b*1 parallel to the Y axis. The existence of the flat portion 111*b*1 enables the chain block 10 to stand alone without falling down. Thereby, the chain block 10 is easy to carry and store or pack.

Figure 8:
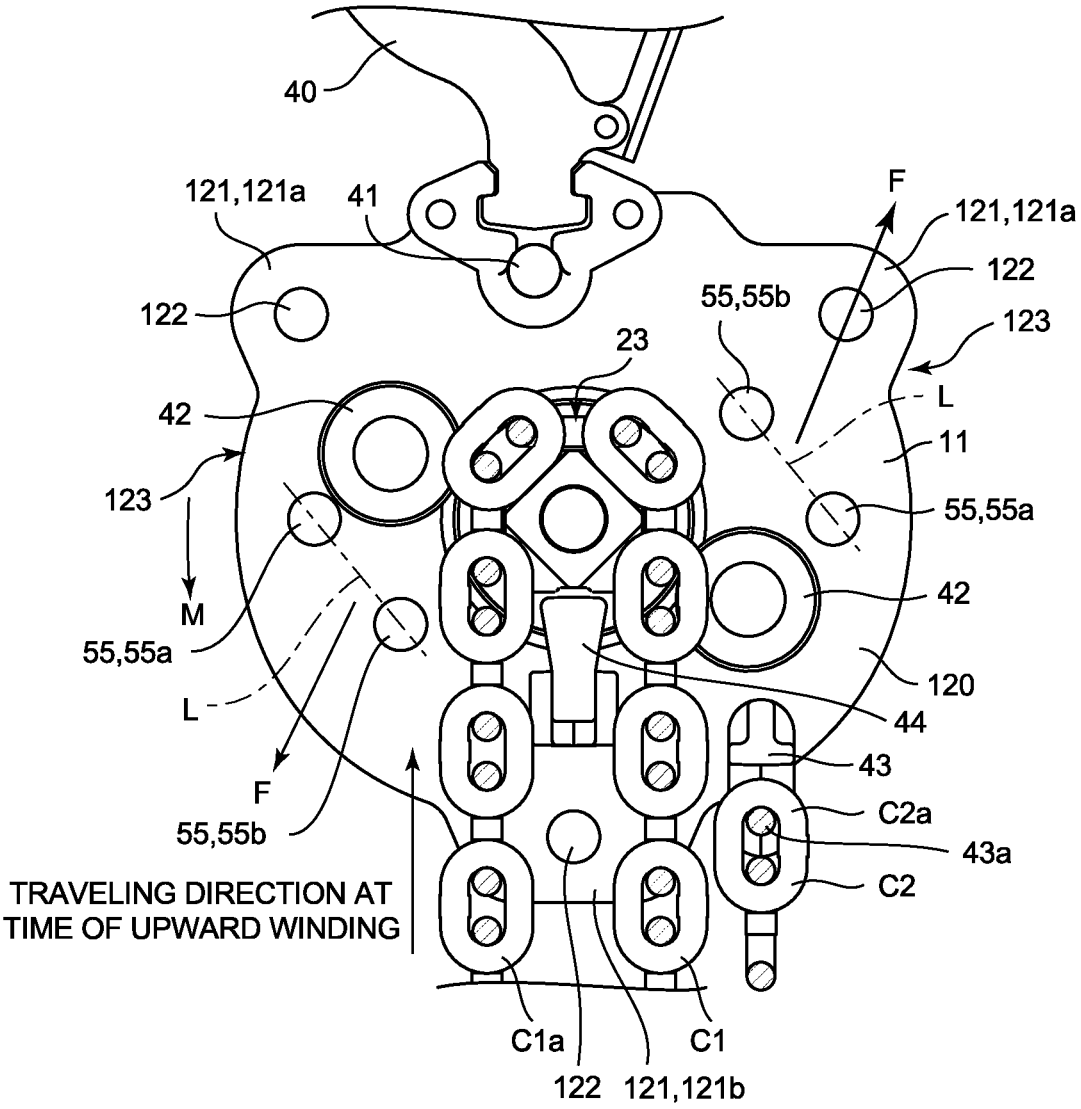
FIG. 8 is a diagram illustrating the positional relation of attaching positions of a fixation member and a guide roller with respect to a first frame in the chain block in FIG. 1.
Figure 8:
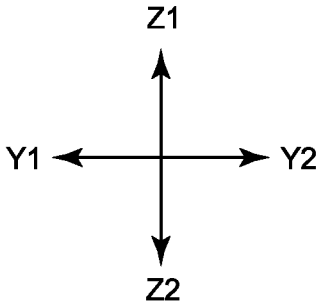

Furthermore, as illustrated in FIG. 8, the second frame 12 is also provided with a circular portion 120, a frame protruding portion 121 (121*a* and 121*b*), an insertion hole 222, and a concave portion 123, which are similar to those of the above-described first frame 11. Since these have similar configurations to the configurations of the respective sites in the first frame 11, the description of each site is omitted. Furthermore, the second frame 12 corresponds to a frame member. However, the first frame 11 may correspond to a frame member, and both of the first and second frames 11 and 12 may correspond to frame members.

Furthermore, as illustrated in FIGS. 4 and 5, a gear fitting portion 22 is provided closer to the gear case 13 side than the bearing fitting portion 21*a* on the first frame 11 side of the load-sheave hollow shaft 20, and a load gear 31 forming the speed reducing mechanism 30 is held in a spline-coupled state by the gear fitting portion 22. Note that the gear case 13 side of the gear fitting portion 22 is provided with a groove portion 22*a* to which a snap ring E is mounted. By the snap ring E mounted to the groove portion 22*a*, the load gear 31 is restricted from moving toward the X2 side of the load gear 31. On the other hand, a clearance groove 22*b* for a spline process is formed at a site on the bearing fitting portion 21*a* side of the gear fitting portion 22, and further a fixation stepped portion 22*c* having a larger diameter than that of the gear fitting portion 22 is provided at a site closer to the bearing fitting portion 21*a* side than the clearance groove 22*b*. The fixation stepped portion 22*c* restricts the load gear 31 from moving toward the X1 side.

Here, the load gear 31 is provided with a central hole 31*a* into which the above-described gear fitting portion 22 is inserted. In addition, as illustrated in FIGS. 4 and 5, concave portions 31*b* are provided around the central hole 31*a* on each end side of the load gear 31. The concave portions 31*b* are provided in the shape of recessing each end surface of the load gear 31 by a predetermined depth. That is, as illustrated in FIGS. 4 and 5, a concave portion 31*b*1 recessed from the end surface on the X1 side of the load gear 31 faces the bearing B1. However, the existence of the concave portion 31*b*1 can increase clearance between the load gear 31 and the bearing B1. Thereby, when the load gear 31 rotates in a state where machine oil (grease) exists between the load gear 31 and the bearing B1, a mechanical loss caused by the viscosity of the machine oil (grease) when the load gear 31 rotates can be reduced, and the fluidity of machine oil (grease) can be improved. Similarly, a concave portion 31*b*2 recessed from the end surface on the X2 side of the load gear 31 faces a large-diameter gear 61 of a reduction gear member 60. However, the existence of the concave portion 31*b*2 can increase clearance between the load gear 31 and the large-diameter gear 61. Also in this case, when the load gear 31 rotates, a mechanical loss caused by the viscosity of machine oil (grease) when the load gear 31 rotates can be reduced, and the fluidity of the machine oil (grease) can be improved.

Furthermore, the load-sheave hollow shaft 20 has a pair of flange portions 23*a* forming the load sheave 23, and further has a chain pocket 23*b* (refer to FIG. 4) forming the load sheave 23 between the pair of flange portions 23*a*. The chain pocket 23*b* is a portion into which a metal hoop C1*a* of a load chain C1 is fitted, and has a horizontal pocket (not illustrated) into which the metal hoop C1*a* is fitted in a state where the direction in which the metal hoop C1*a* becomes flat is parallel to the axial direction (X direction), and a vertical pocket (not illustrated) which has a deeper groove shape than the horizontal pocket and into which the metal hoop C1*a* is fitted in a state where the direction in which the metal hoop C1*a* becomes flat crosses the axial direction (X direction).

Furthermore, the load-sheave hollow shaft 20 is provided with a hollow hole 24. A drive shaft 70 is inserted into the hollow hole 24, and an end portion on the second frame 12 side of the hollow hole 24 is provided with a bearing stepped portion 26 for receiving a bearing B3 which shaft-supports the drive shaft 70. Here, an end portion on the gear fitting portion 22 side of the hollow hole 24 is provided with a receiving concave portion 27 for receiving a flange portion 71 of the drive shaft 70. By the flange portion 71 of the drive shaft 70 positioned in the receiving concave portion 27, the length along the axial direction (X direction) of the drive shaft 70 can be reduced, and the dimension along the X direction (the axial direction of the drive shaft 70) of the chain block 10 can be reduced. Furthermore, By the reduced length along the axial direction of the drive shaft 70, the strength of the drive shaft 70 can be improved.

As illustrated in FIGS. 1 to 6, the upper hook 40 is mounted to the first and second frames 11 and 12 through a connecting shaft 41 (refer to FIGS. 6 and 8), and mounted in a rotatable state with respect to the connecting shaft 41. A hook latch 40*a* which is biased in a closing direction by a basing unit (not illustrated) is mounted to the upper hook 40.

Figure 2:
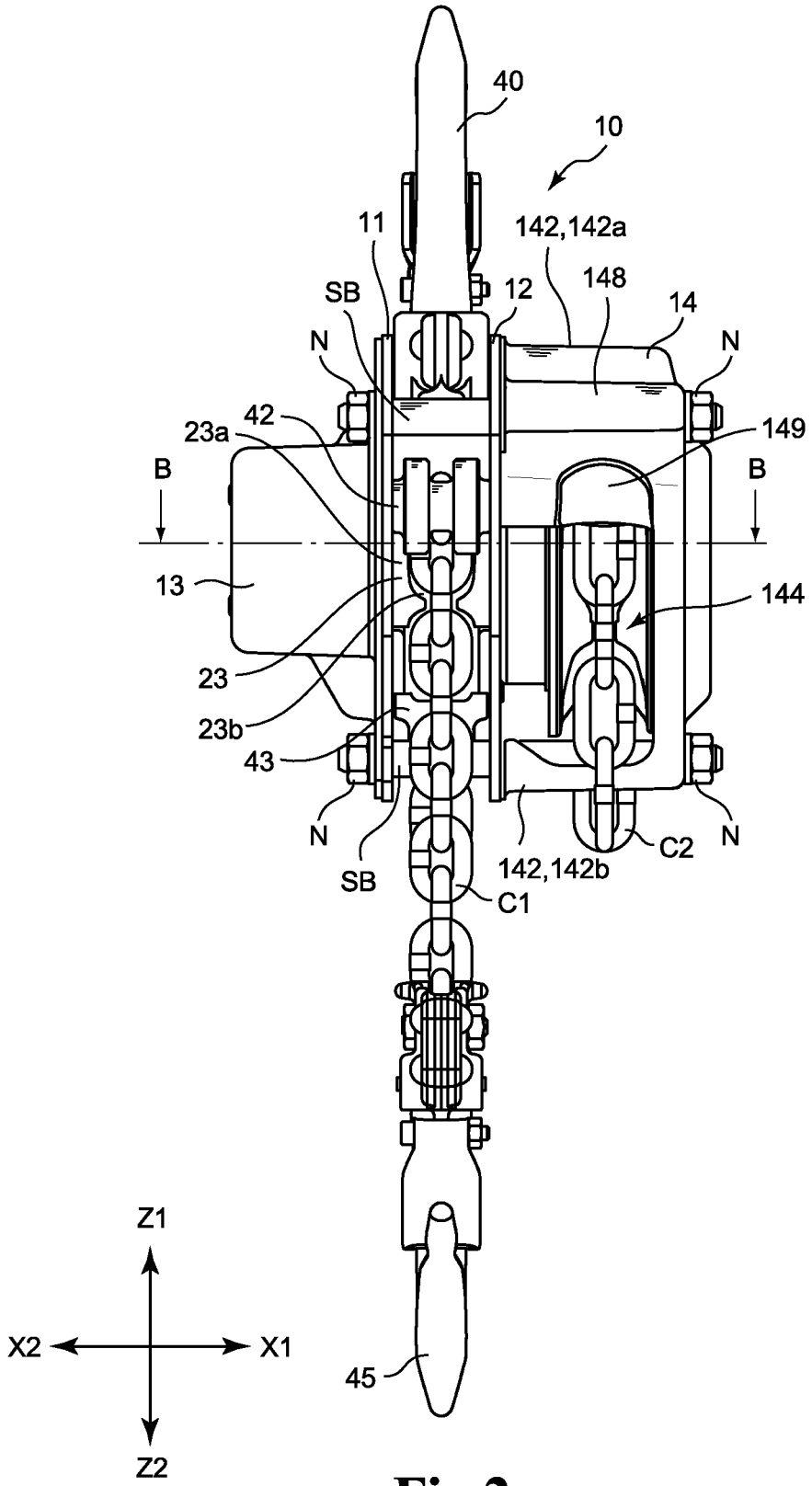
FIG. 2 is a side view illustrating the appearance of the chain block of FIG. 1.

One end side and the other end side of the guide roller 42 illustrated in FIGS. 2 and 8 are shaft-supported rotatably with respect to the first frame 11 and the second frame 12, respectively. For example, a pair of guide rollers 42 are provided at an interval of 180 degrees with the center of the load-sheave hollow shaft 20 interposed therebetween. The guide roller 42 is a member which rotates as the load chain C1 is wound up or the like, and mounted facing the load sheave 23 and being separated by a distance to prevent the load chain C1 from coming off the chain pocket 23*b*.

The metal fastener 43 illustrated in FIGS. 1 to 4 and 9 is a portion to which a metal fitting pin 43*a* is mounted, and the metal fitting pin is inserted into the metal hoop C1*a* in an end portion of the load chain C1, which is opposite to the side to which the lower hook 45 is mounted. One end side and the other end side of the metal fastener 43 are also shaft-supported rotatably with respect to the first frame 11 and the second frame 12, respectively.

The stripper 44 illustrated in FIG. 4 is a member that prevents the occurrence of a lock state in which the load chain C1 looped over the load sheave 23 follows the load sheave 23 more than necessary and the load sheave 23 is stuck. Respective end portions on one end side and the other end side of the stripper 44 are inserted into respective support holes 11*b* and 12*b* existing in the first and second frames 11 and 12, and thus the stripper 44 is mounted to the first and second frames 11 and 12.

Figure 7A:
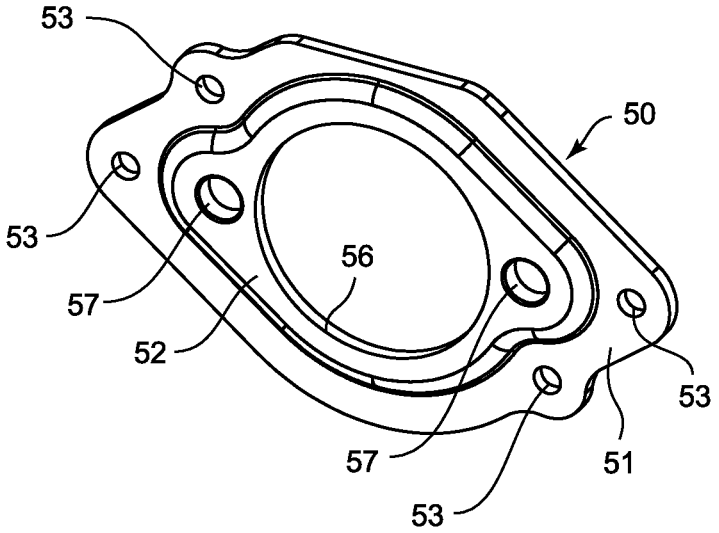
FIG. 7A is a perspective view illustrating the shape of the auxiliary plate in the chain block in FIG. 1, when seen from the front side.
Figure 7B:
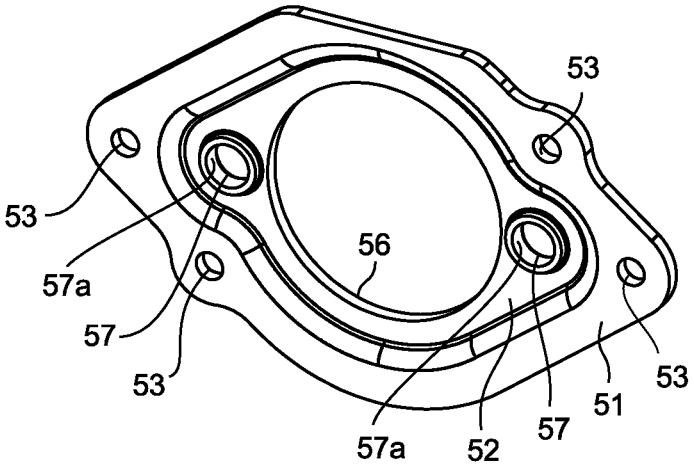
FIG. 7B is a perspective view illustrating the shape of the auxiliary plate in the chain block in FIG. 1, when seen from the rear side.

Furthermore, as illustrated in FIGS. 4 to 6, an auxiliary plate 50 illustrated in FIGS. 7A and 7B is mounted to an end surface on the side facing the gear case 13 of the first frame 11. The auxiliary plate 50 is provided with a flange portion 51 and a drawing portion 52. The flange portion 51 is a portion that comes in contact with the end surface of the first frame 11, and the flange portion 51 is provided with a fixation hole 53. Then, the auxiliary plate 50 is mounted to the first frame 11 by inserting a fixation member 55 such as a rivet (refer to FIG. 5) into the fixation hole 53 and a mounting hole 11*c* provided in the first frame 11. Furthermore, the drawing portion 52 is a portion positioned closer to the center side than the flange portion 51, and is a portion formed by, for example, drawing the center side of the auxiliary plate 50 so as to be spaced by a predetermined distance from the end surface of the first frame 11. In the present embodiment, the drawing portion 52 has a recessed portion existing on the outer peripheral side thereof due to the existence of the fixation hole 53 in the configuration illustrated in FIGS. 6, 7A, and 7B; however, the drawing portion 52 has a corner formed in an R-shaped approximately rhombic shape, except the recessed portion.

Here, the mounting positions of the above-described fixation member 55 and the guide roller 42 with respect to the first frame 11 are in a positional relation illustrated in FIG. 8. That is, the pair of guide rollers 42 are mounted adjacent to respective fixation members 55, and arranged at symmetrical positions with the center interposed between the guide rollers 42. Furthermore, the guide rollers 42 are provided adjacent to the fixation members 55 (55*a*) separated from the rotation center of the load sheave 23 or the like, and are also provided at positions spaced apart from the fixation members 55 (55*b*) close to the center with the Y direction interposed therebetween. In such an arrangement, when the load chain C1 is wound up, the entire chain block 10 tends to rotate along a rotation direction M of FIG. 8 such that a direction F of a force received from the load chain C1 becomes a direction orthogonal to a line L connecting the fixation members 55 adjacent to each other. In such rotation, when the guide rollers 42 are arranged as illustrated in FIG. 8, a line connecting the pair of guide rollers 42 approaches the horizontal state, and a guide property of the load chain can favorably be maintained.

Furthermore, as illustrated in FIGS. 6, 7A, and 7B, a central hole 56 is provided on the center side of the drawing portion 52. The central hole 56 is provided on the same axis as the above-described insertion hole 11*a*, and has the same diameter as that of the insertion hole 11*a*. Then, the above-described bearing B1 is positioned in the central hole 56 to support the load-sheave hollow shaft 20. Furthermore, the drawing portion 52 is provided with a bearing hole 57 along a diagonal in the longitudinal direction of the approximately rhombic shape thereof. For example, a pair of bearing holes 57 are provided at positions by an equal distance from the center of the central hole 56, and are each formed in a shape having a rising portion 57*a* by burring processing, for example. A shaft support portion 63 on one end side of the reduction gear member 60 (X1 side in FIG. 5) is inserted into the bearing hole 57, and the reduction gear member 60 is shaft-supported by the bearing hole. Note that a shaft support portion 64 on the other end side of the reduction gear member 60 (X2 side in FIG. 5) is inserted into a bearing hole 13*a* of the gear case 13 through a bearing B4 such as a bush, and the reduction gear member 60 is shaft-supported by the bearing hole 13*a*.

Figure 10A:
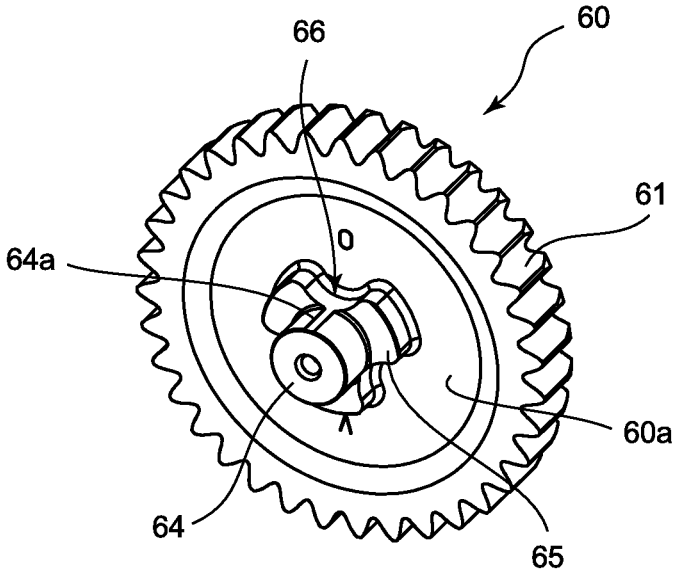
FIG. 10A is a perspective view illustrating the shape of the reduction gear member in the chain block in FIG. 1, when seen from the front side.
Figure 10B:
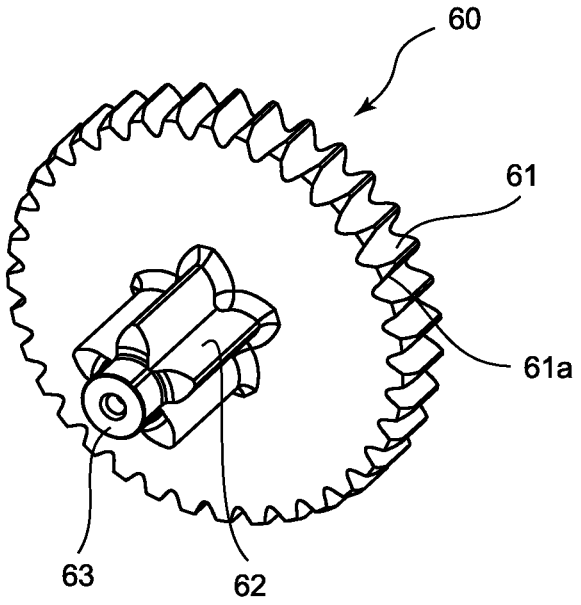
FIG. 10B is a perspective view illustrating the shape of the reduction gear member in the chain block in FIG. 1, when seen from the rear side.

As illustrated in FIGS. 5, 10A, and 10B, each of a pair of reduction gear members 60 (the arrangement of the pair of reduction gear members 60 is also illustrated in FIG. 9) is provided with the large-diameter gear 61 (corresponding to a first reduction gear member) and a small-diameter gear 62 (corresponding to a second reduction gear member), and is also provided with the shaft support portion 63 inserted into the bearing hole 57 and the shaft support portion 64 inserted into the bearing hole 13*a* as described above. The large-diameter gear 61 engages with a pinion gear 72 of the drive shaft 70, and a driving force is transferred from the drive shaft 70 to the reduction gear member 60 at a first reduction gear ratio. Furthermore, the large-diameter gear 61 is provided with a chamfered surface portion 61*a*. The chamfered surface portion 61*a* is provided at a site on the X1 side of the outer peripheral side of the large-diameter gear 61, and is provided having a smaller diameter than that of another site of the large-diameter gear 61. The existence of the chamfered surface portion 61*a* prevents the large-diameter gear 61 from interfering with an inclined portion 73 and a curved surface portion 74 of the drive shaft 70.

Furthermore, the small-diameter gear 62 engages with the load gear 31, and the driving force transferred to the reduction gear members 60 is transferred to the load gear 31 at a second reduction gear ratio. Note that the small-diameter gear 62 and the above-described large-diameter gear 61 are integrally formed by cold forging, for example. However, the small-diameter gear 62 and the large-diameter gear 61 may be integrally formed by a combination of other processing such as precise forging and cutting, and may be separately formed by a combination of the above-described processing and thereafter coupled to each other.

As illustrated in FIG. 10A, a swelling portion 65 is provided closer to the large-diameter gear 61 side (X1 side) than the shaft support portion 64 of the reduction gear member 60. The swelling portion 65 is provided in a concave portion 60*a* provided in a central portion of an end surface of the reduction gear member 60, but the swelling portion 65 is a portion swelling toward the outside in the radial direction so as to have a larger diameter than that of the shaft support portion 64, and is intermittently swelling along the peripheral direction (in FIG. 10A, three swelling portions 65 are provided). Then, a recessed portion 66 having a relatively smaller diameter than that of the swelling portion 65 exists between the adjacent swelling portions 65. Furthermore, the outer peripheral side of the shaft support portion 64 is provided with an oil groove 64*a* along the axial direction (X direction) of the reduction gear member 60, and the oil groove 64*a* is in communication with any one of recessed portions 66. Thereby, machine oil (grease) can be supplied to the bearing B4 such as a bush through the concave portion 60*a* and the oil groove 64*a*. Furthermore, the existence of the above-described swelling portion 65 can make the large-diameter gear 61 spaced apart from the bearing B4, and the existence of the concave portion 60*a* and the oil groove 64*a* can reduce a mechanical loss caused by the viscosity of the machine oil (grease) between the large-diameter gear 61 and bearings B4 and B5, and improve the fluidity of the machine oil (grease).

As illustrated in FIGS. 4 and 5, the drive shaft 70 (refer to FIGS. 11A to 11C) is a member extending from the gear case 13 side to the hand wheel 80 side along the X direction. The drive shaft 70 is inserted into the hollow hole 24 of the load-sheave hollow shaft 20 as described above, and provided rotatably with respect to the load sheave 23 through the bearing B3 at the bearing stepped portion 26. Furthermore, the drive shaft 70 is provided with the flange portion 71, and the flange portion 71 is positioned in the receiving concave portion 27. Then, by the flange portion 71 received in a bottom portion 27*a* of the receiving concave portion 27, the drive shaft 70 is restricted from moving toward the hand wheel 80 side, and the dimension in the axial direction of the drive shaft 70 can be reduced.

Figure 12A:
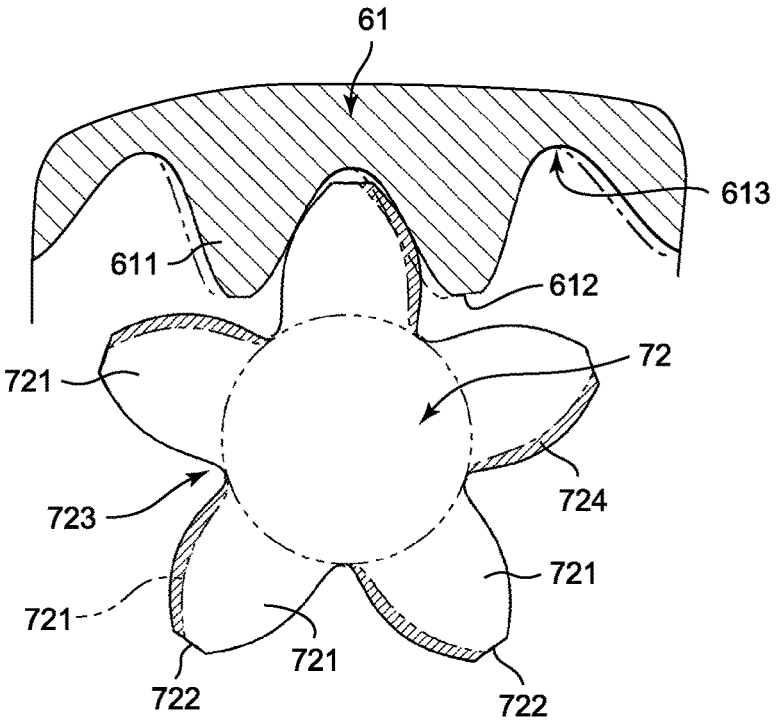
FIG. 12A illustrates an engagement state between a pinion gear and a large-diameter gear according to the present embodiment.
Figure 12B:
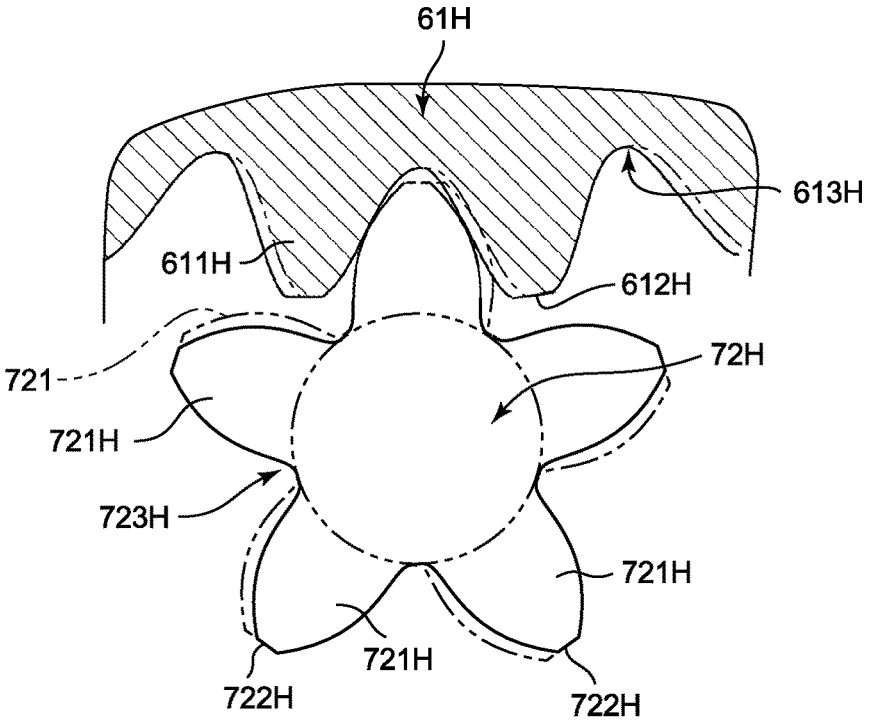
FIG. 12B illustrates an engagement state between a pinion gear and a large-diameter gear according to a configuration of the related art.

A portion protruding from the hollow hole 24 toward the gear case 13 side (X2 side) of the drive shaft 70 is provided with the pinion gear 72 (corresponding to a first gear) engaging with the above-described large-diameter gear 61. In FIG. 12A, the pinion gear 72 has five teeth 721. A thickness Da of each tooth 721 of the pinion gear 72 is set to be different from a thickness Db of a tooth 721H of a pinion gear 72H according to the related art as illustrated in FIG. 13B. That is, in the pinion gear 72 according to the present embodiment, the thickness Da of a tooth tip 722 of each tooth 721 (hereinafter, the thickness Da of the tooth tip 722 is referred to as a thickness Da2 as illustrated in FIG. 13A) is provided to be larger than the thickness Db of a tooth tip 722H of each tooth 721H according to the related art (hereinafter, the thickness Db of the tooth tip 722H is referred to as a thickness Db2 as illustrated in FIG. 13B).

Note that, as described above, when the thickness Da2 of the tooth tip 722 is made larger than the thickness Db2 of the tooth tip 722H according to the related art, the thickness Da of each tooth 721 can be made as follows. That is, in the pinion gear 72 according to the present embodiment, a dimension Ba (not illustrated) of a tooth bottom 723 existing between the neighboring teeth 721 is provided to be smaller than a dimension Bb (not illustrated) of a tooth bottom 723H of the pinion gear 72H according to the related art. Thus, on the tooth bottom 723 side, the thickness Da of the tooth 721 (hereinafter, the thickness Da on the tooth bottom 723 side is referred to as a thickness Da1 as illustrated in FIG. 13A) is provided to be larger than the thickness Db of the tooth 721 according to the related art (hereinafter, the thickness Db on the tooth bottom 723H side is referred to as a thickness Db1 as illustrated in FIG. 13B).

Figure 13A:
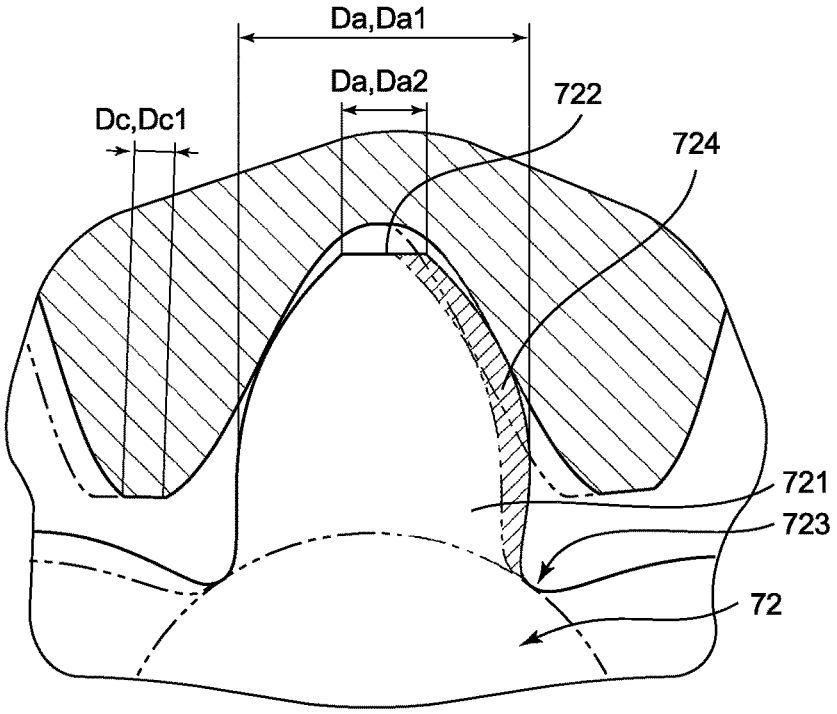
FIG. 13A is a diagram illustrating the relation in tooth thickness between the pinion gear and the large-diameter gear according to the present embodiment.
Figure 13B:
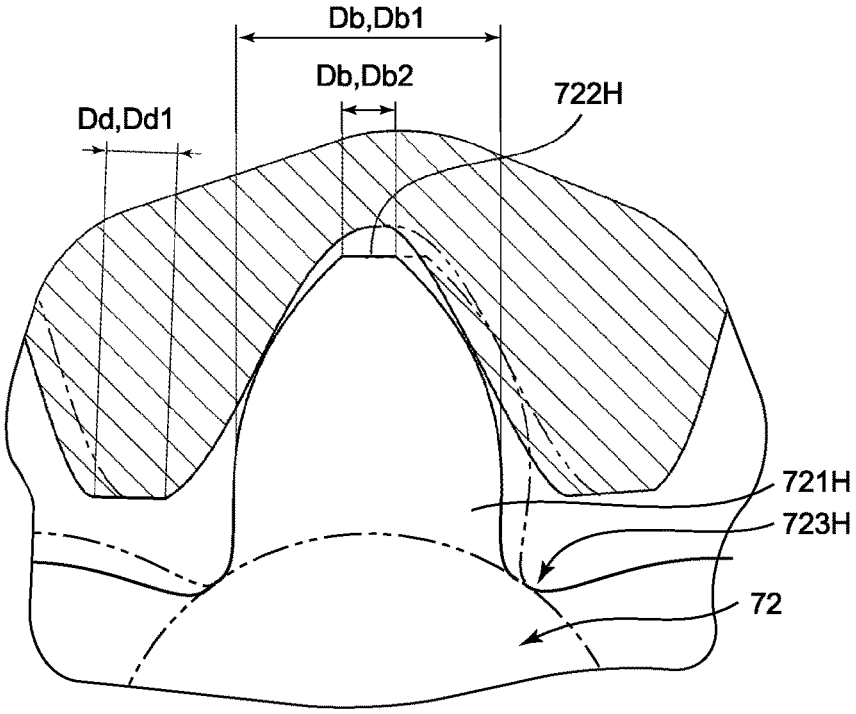
FIG. 13B is a diagram illustrating the relation in tooth thickness between the pinion gear and the large-diameter gear according to the configuration of the related art.

In addition, the thicknesses Da and Db at each site of the teeth 721 and 712H are considered as illustrated in FIGS. 13A and 13B. In this case, in the configuration illustrated in FIG. 13A, the ratio of a thickened portion 724 in the tooth thickness Da of the tooth 721 in the present embodiment is set to increase from the side of the tooth bottom 723 to a side of the tooth tip 722, as compared with the tooth thickness Db of the tooth 721H in the related art. Accordingly, since the ratio of the thickened portion 724 is larger on the side of the tooth tip 723, strength of the tooth 721 on the side of the tooth tip 723 can be improved significantly.

Note that the thickness Da of each tooth 721 may be set as follows. That is, the thickness Da1 on the tooth bottom 723 side may be set to be equal to the thickness Db1 on the tooth bottom 723H side of the tooth 721H according to the related art. In this case, however, it is necessary to prevent an undercut from occurring on the tooth bottom 723 side. Note that, when the thickness Da1 on the tooth bottom 723 side is provided as described above to be equal to the thickness Db1 on the tooth bottom 723H side of the tooth 721H according to the related art, the dimension of the thickened portion 724 may be set to become large from the tooth bottom 723 toward the tooth tip 722.

Furthermore, each tooth 611 of the large-diameter gear 61 engaging with the pinion gear 72 as described above is thinned by an amount corresponding to thickening of the thickened portion 724 of the tooth 721. That is, in the large-diameter gear 61, a tooth thickness Dc (refer to FIG. 13A) of the tooth 611 is smaller than a tooth thickness Dd (refer to FIG. 13D) of the tooth 611H according to the related art as much as the increasing amount from the tooth thickness Db of the tooth 721H of the pinion gear 72H according to the related art to the tooth thickness Da of the tooth 721 of the pinion gear 72. At this time, the thickness Da2 of the tooth tip 722 of the pinion gear 72 is provided to be larger than the thickness Dc1 of the tooth tip 612 of the large-diameter gear 61. Here, in a portion where the tooth 721 and the tooth 611 come in contact with each other, the change in the thickness Da of the tooth 721 from the tooth bottom 723 side to the tooth tip 722 side in the pinion gear 72 (the thickened portion 724) corresponds to the change in the thickness Dc of the tooth 611 from the tooth tip 612 side to the tooth bottom 613 side in the large-diameter gear 61. Thereby, the favorable engagement between the pinion gear 72 and the large-diameter gear 61 is realized.

Note that, in the configurations illustrated in FIGS. 12A, 12B, 13A, and 13B, the pinion gear 72 is provided with the five teeth 721, and the large-diameter gear 61 is provided with 35 teeth 611. Moreover, a pair of large-diameter gears 61 (reduction gear member 60) are arranged at symmetrical positions with the pinion gear 72 interposed therebetween, and the pinion gear 72 is engaged with both of the pair of large-diameter gears 61. Thus, when the tooth 611 of the large-diameter gear 61 rotates once, the tooth 611 of the large-diameter gear 61 comes in contact with the tooth 721 of the pinion gear 72 only once; however, during one rotation of the large-diameter gear 61, the tooth 721 of the pinion gear 72 comes in contact with the tooth 611 of the large-diameter gear 61 fourteen times.

Furthermore, each of the reduction gear member 60 and the drive shaft 70 is made of a metal and is preferably made of an iron-based metal from a viewpoint of abrasion resistance. Furthermore, the reduction gear member 60 and the drive shaft 70 are preferably made of similar materials. However, at least the pinion gear 72 of the drive shaft 70 may be made of a material having wear resistance more excellent than that of the large-diameter gear 61 of the reduction gear member 60.

Figure 11A:
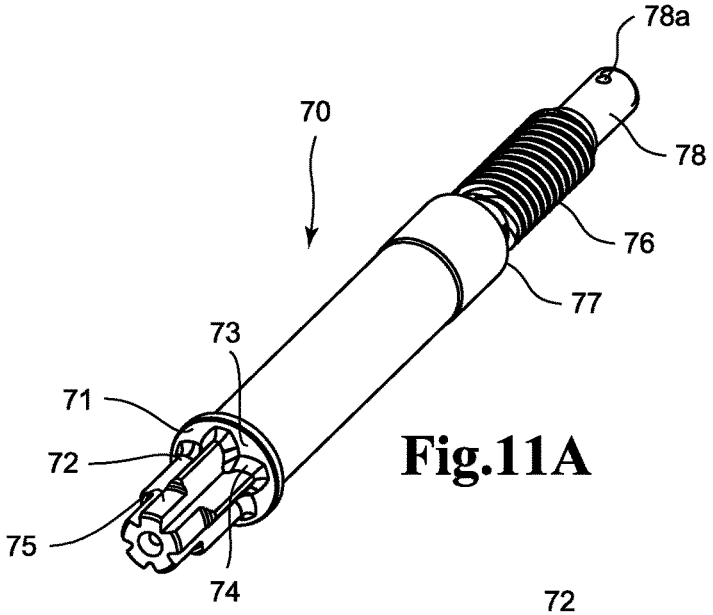
FIG. 11A is a perspective view illustrating the shape of a drive shaft in the chain block in FIG. 1, when seen from the front side.
Figure 11B:
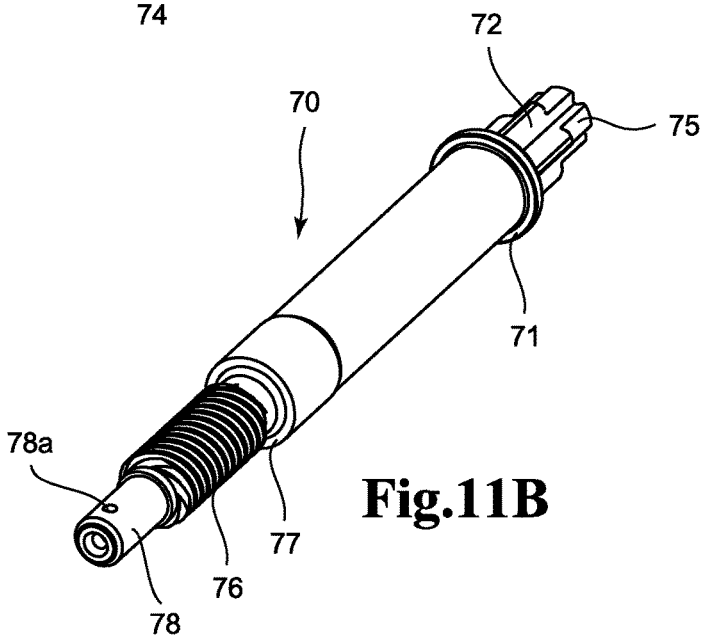
FIG. 11B is a perspective view illustrating the shape of the drive shaft in the chain block in FIG. 1, when seen from the rear side.
Figure 11C:
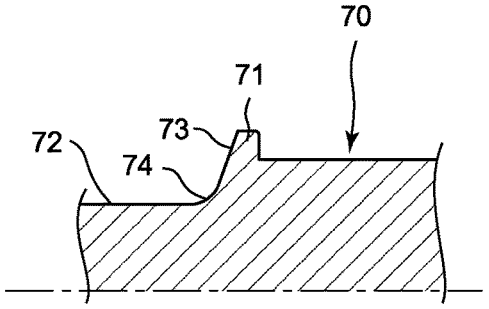
FIG. 11C is a partial expanded side cross-sectional view of the drive shaft in the chain block in FIG. 1, illustrating the shape of the vicinity of a flange portion.

A portion protruding from the hollow hole 24 toward the gear case 13 side (X2 side) of the drive shaft 70 is provided with the pinion gear 72 (corresponding to a gear portion) engaging with the above-described large-diameter gear 61. As illustrated in FIGS. 11A and 11C, a base portion of the pinion gear 72 with respect to the flange portion 71 is provided with the inclined portion 73. Further, the predetermined curved surface portion 74 is provided between each tooth of the pinion gear 72 and the inclined portion 73. The curved surface portion 74 is formed in a round shape, for example. Then, the existence of the inclined portion 73 and the curved surface portion 74 can prevent concentration of stress from occurring in a boundary portion between the pinion gear 72 and the flange portion 71. It is to be noted that the curved surface portion 74 has only to be 1/10 or larger of the inclined portion 73, and by setting the ratio thereof in the inclined portion 73 to 1/10 or larger, the stress concentration can be prevented favorably.

Here, the thickness on the tip side of the tooth of the pinion gear 72 is provided to be larger than the thickness on the tip side of the large-diameter gear 61 engaging with the pinion gear 72. Thus, the lifetime of the pinion gear 72 can be prolonged. That is, since the number of teeth of the pinion gear 72 is smaller than the number of teeth of the large-diameter gear 61, each tooth of the pinion gear 72 slides more times than each tooth of the large-diameter gear 61. Thereby, each tooth of the pinion gear 72 wears earlier than each tooth of the large-diameter gear 61. However, by setting the tooth thickness on the tip end side of the tooth of the pinion gear 72 to be larger than the tooth thickness on the tip end side of the large-diameter gear 61 and setting the tooth width to be larger, lifetime of the pinion gear 72 can be prolonged.

Furthermore, the drive shaft 70 is provided with a shaft support portion 75 closer to the gear case 13 side (X2 side) than the pinion gear 72. The shaft support portion 75 is a portion to which the bearing B5 is mounted on the outer peripheral side thereof, and the bearing B5 is mounted to a bearing mounting portion 13*b* provided in the gear case 13. Thereby, an end portion on the X2 side of the drive shaft 70 is rotatably supported by the gear case 13 through the bearing B5. Further, a male screw portion 76 is provided on the hand wheel 80 side of the drive shaft 70. The male screw portion 76 is a portion to which a female screw portion 81 of the hand wheel 80 or a female screw portion 91*a* of a brake receiver 91, which will be described below, are screwed. Note that an end portion on the X2 side of the male screw portion 76 is provided with a stepped portion 77, and the brake receiver 91 to be described below is locked by the stepped portion 77. Furthermore, a stopper receiving portion 78 having a pin hole 78*a* is provided closer to the X1 side than the male screw portion 76, and a wheel stopper 84 to be described below is arranged in the stopper receiving portion 78 and retained by a stopper pin 79.

Note that the gear case 13 is a member that covers the speed reducing mechanism 30 such as the reduction gear member 60 and the load gear 31, and the gear case 13 is fixed to the first frame 11 via the stud bolt SB and the nut N.

As illustrated in FIGS. 4 and 5, an end surface of the second frame 12 on the side not facing the first frame 11 is provided with the hand wheel 80 and a brake mechanism 90. The hand wheel 80 has the female screw portion 81 on the center side thereof, and the female screw portion 81 is screwed to the male screw portion 76 of the drive shaft 70. Furthermore, a chain pocket 82 similar to the above-described load sheave 23 is provided between sites of the outer peripheral side of the hand wheel 80, facing a pair of flange portions 80*a*. The chain pocket 82 is a portion into which a metal hoop C2*a* of a hand chain C2 is fitted, and has a horizontal pocket (not illustrated) into which the metal hoop C2*a* is fitted in a state where the direction in which the metal hoop C2*a* becomes flat is parallel to the axial direction, and a vertical pocket (not illustrated) which has a deeper groove shape than the horizontal pocket and into which the metal hoop C2*a* is fitted in a state where the direction in which the metal hoop C2*a* becomes flat crosses the axial direction. Note that the wheel stopper 84 is provided closer to the tip side of the male screw portion 76 (X1 side) than the hand wheel 80 via a collar 83 or the like. The wheel stopper 84 is a ring-shaped member and has a through-hole 84*a* along the radial direction. Then, by inserting a stopper pin 85 into the through-hole 84*a* and the pin hole 78*a* of the stopper receiving portion 78, the wheel stopper 84 is restricted from moving in the X direction of the drive shaft 70. The existence of the wheel stopper 84 restricts the hand wheel 80 from moving to the X1 side.

Furthermore, the brake mechanism 90 includes the brake receiver 91, a brake plate 92, a ratchet wheel 94, a pawl member 95, and like as main components. As illustrated in FIGS. 4 and 5, the brake receiver 91 is arranged on the second frame 12 side of the male screw portion 76 of the drive shaft 70. The brake receiver 91 has the female screw portion 91*a* on the center side thereof, and further has a flange portion 91*b* and a hollow boss portion 91*c*. The female screw portion 91*a* is a portion that is screwed to the male screw portion 76 of the drive shaft 70, and the flange portion 91*b* of the brake receiver 91 is locked by the stepped portion 77 by the screwing of the female screw portion. The flange portion 91*b* is provided to have a larger diameter than that of the hollow boss portion 91*c*, and can receive the brake plate 92 to be described below. The hollow boss portion 91*c* is positioned closer to the hand wheel 80 side (X1 side) than the flange portion 91*b*, and supports the ratchet wheel 94 via a bush 93 to be described below.

The brake plate 92 (92*a*) is positioned between the flange portion 91*b* and the ratchet wheel 94 to be described below. When pressurized from the hand wheel 80 side, the brake plate applies a large frictional force between the flange portion 91*b* and the ratchet wheel 94 to be described below, and the brake receiver 91 integrally rotates with the ratchet wheel 94 by the large frictional force. Note that the brake plate 92 (92*b*) is also arranged between the ratchet wheel 94 and the hand wheel 80 and applies a large frictional force between the ratchet wheel 94 and the hand wheel 80 by being pressurized from the hand wheel 80, and the hand wheel 80 integrally rotates with the ratchet wheel 94 by the large frictional force.

As illustrated in FIGS. 4 and 5, the bush 93 is mounted to the hollow boss portion 91*c* of the brake receiver 91, and the ratchet wheel 94 is provided on the outer peripheral side of the bush 93. Thereby, the ratchet wheel 94 is provided rotatably with respect to the brake receiver 91. As illustrated in FIG. 14, a tip end of each pawl member 95 engages with a tooth portion 94*a* of the ratchet wheel 94, and the engagement thereof forms a ratchet wheel mechanism which prevents the ratchet wheel 94 from rotating in the opposite direction (rotating in the winding-up direction). Note that the pawl member 95 is rotatably provided through a pawl shaft 95*a*, and one end of a biasing spring 95*b* is attached to the pawl member 95, so that a basing force is applied such that the tip of the pawl member 95 always engages with the tooth portion 94*a* of the ratchet wheel 94.

Furthermore, a pair of pawl member 95 are provided. In the configuration illustrated in FIG. 14, one pawl member 95 is arranged at a position where the pawl member is inclined at a predetermined angle such as 30 degrees to the vertical direction. Furthermore, the other pawl member 95 is provided at a position adjacent to the one pawl member 95. However, the arrangement mode thereof is an arrangement where the pair of pawl member 95 are both fitted into the same quadrant such as the first quadrant of the orthogonal coordinate system. Thereby, a space S is formed at a position corresponding to the third quadrant with respect to the first quadrant of the orthogonal coordinate system (a position on the Z2 side and the Y2 side in FIG. 14), and when the load chain C1*a* is wound up, the lower hook 45 can be positioned in the space S. However, other arrangements may be employed as the arrangement of the pair of pawl member 95, and for example, a configuration of arranging each of the pair of pawl members in a diagonal direction with the rotation center of the ratchet wheel 94 interposed therebetween may be employed.

The wheel cover 14 is a member that covers the upper side of the hand wheel 80 and the upper side of the brake mechanism 90 (refer to FIGS. 1 to 3 and the like), and the wheel cover 14 is fixed to the second frame 12 through the stud bolt SB and the nut N. The wheel cover 14 is formed by plastic working such as press working, and includes, as illustrated in FIG. 15, a flange portion 141, a side surface 142, and an end surface 143, which are formed by the plastic working. The flange portion 141 is a portion that abuts against the second frame 12. The flange portion 141 is surface-bonded to the second frame 12, and thereby provided in a state of favorably resisting a tightening force between the stud bolt SB and the nut B. In order to realize such surface-bonding, the flange portion 141 is formed to expand outward with respect to the side surface 142 in parallel to the second frame 12 toward the tip side (X2 side) spaced apart from the end surface 143.

Note that the flange portion 141 is bent at an angle nearly perpendicular to the side surface 142; however, in a state where the wheel cover 14 is mounted, the side surface 142 is not necessarily perpendicular to the second frame 12. Thus, the flange portion 141 may be bent at an angle perpendicular to the side surface 142, but not necessarily bent perpendicularly.

Furthermore, the wheel cover 14 illustrated in FIG. 15 and the like may be formed by deep-drawing a steel plate or the like.

The side surface 142 is a portion that connects between the flange portion 141 and an outer periphery edge portion of the end surface 143, and is formed as illustrated in FIG. 1 so as to have a large dimension in the approaching and separating direction (X direction) relative to the second frame 12. Furthermore, the side surface 142 is not provided over the entire outer peripheral edge portion of the end surface 143. That is, the side surface 142 has a portion positioned on the upper side (hereinafter, referred to as an upper side surface 142*a* as necessary) and a portion positioned on the lower side (hereinafter, referred to as a lower side surface 142*b* as necessary). Note that a pair of sets of stud bolts SB and nuts N are provided on the upper side of the wheel cover 14 (Z1 side) along the Y direction. On the other hand, only one set of the stud bolt SB and the nut B exists on the lower side (Z2 side) of the wheel cover 14. Thus, the upper side surface 142*a* is provided to have a larger dimension in the Y direction than the lower side surface 142*b*, and a pair of wrap-around portions 148 (described below) also exist in the upper side surface 142*a*.

Note that the hand chain C2 can extends from a notched portion 144 between the upper side surface 142*a* and the lower side surface 142*b*. Furthermore, a left-right side surface 145 is provided at a site closer to the end surface 143 side than the notched portion 144. The left-right side surface 145 is a portion extending toward the second frame 12 more than the end surface 143 in a similar manner to the upper side surface 142*a* and the lower side surface 142*b*; however, the left-right side surface 145 is provided to have the length toward the second frame 12 significantly smaller than those of the upper side surface 142*a* and the lower side surface 142*b*, due to the existence of the notched portion 144.

Furthermore, the end surface 143 is a portion facing to the hand wheel 80 of the wheel cover 14. The end surface 143 is provided so as to be continuous with the upper side surface 142*a*, the lower side surface 142*b*, and the left-right side surface 145 in the outer peripheral edge portion thereof. Furthermore, the end surface 143 has large dimensions in the Y direction and the Z direction (corresponding to the drooping direction) in FIG. 15. The end surface 143 may be provided in a planar shape; however, as illustrated in FIG. 15, a configuration where unevenness exists may be employed in order to improve the designability and improve the strength of the wheel cover 14.

Figure 3:
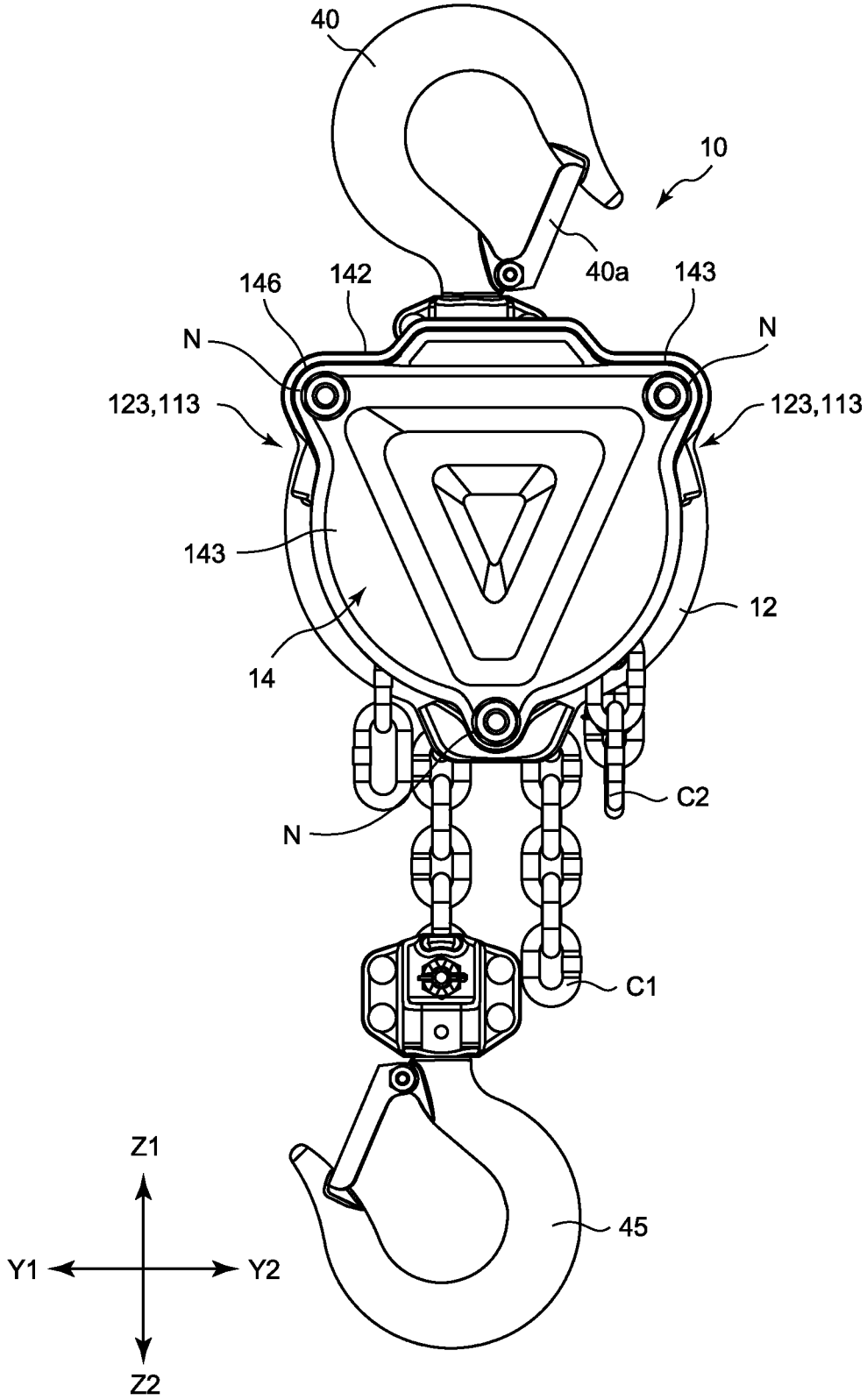
FIG. 3 is a rear view illustrating the appearance of the chain block of FIG. 1.

Furthermore, as illustrated in FIGS. 3 and 15, in the present embodiment, the end surface 143 is provided with a circular portion T1 having a circular shape where the radius from the center to the edge portion is R1 (in FIGS. 3 and 15, the circular shaped portion has a partially circular shape of which a portion on the upper side is cut; however, such a partially circular shape is described hereinafter being included in the circular shape) overlapping a triangular portion T2 having a triangle shape where the distance from the same center to the edge portion is R2. Here, the radius R1 and the distance R2 has the relation of R2>R1. Thereby, the corner sides of the triangular portion T2 are provided to protrude from the circular portion T1. Hereinafter, the portion protruding from the circular portion T1 is referred to as a protruding portion 146.

Furthermore, in the present embodiment, the triangular portion T2 is provided in an isosceles triangle shape of which the base is positioned on the upper side and of which the vertex is positioned on the lower side; however, the triangular portion may be provided in an equilateral triangle shape or an approximately equilateral triangle shape. Furthermore, the triangular shaped portion may be provided in other triangle shapes than the isosceles triangle shape.

As illustrated in FIGS. 3 and 15, the protruding portion 146 is provided with a bolt hole 147 (corresponding to the fixation hole). Since the bolt hole 147 is provided in the protruding portion 146, three bolt holes 147 are provided on the outer peripheral edge portion side of the wheel cover 14, and two of the bolt holes are provided along the Y direction on the upper side (Z1 side).

Figure 16:
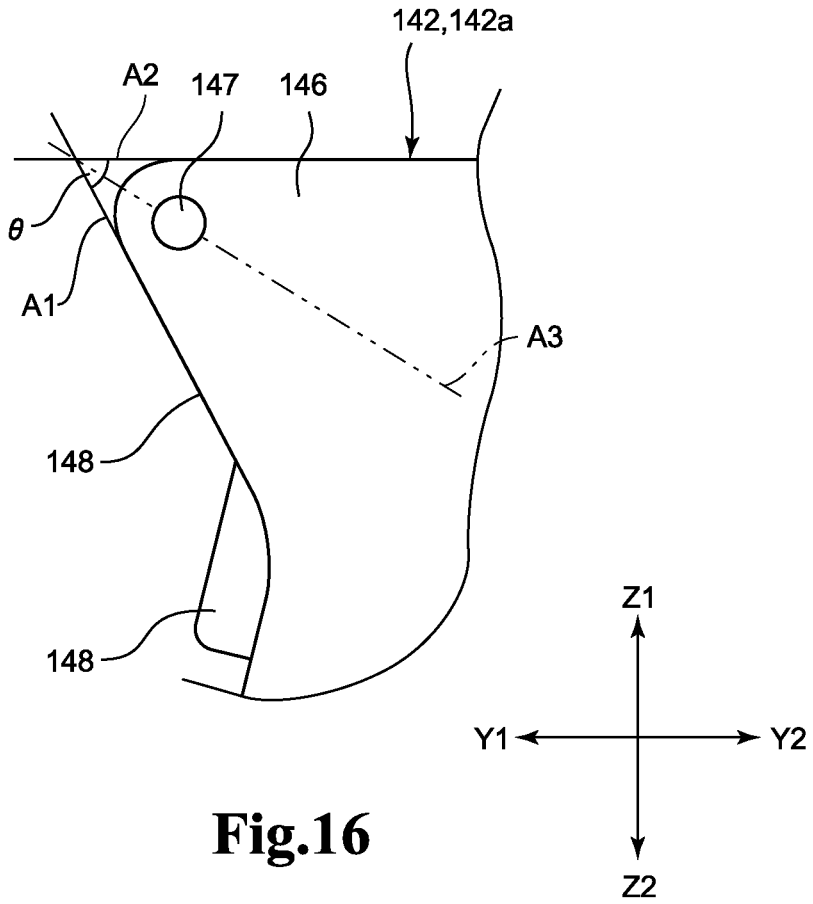
FIG. 16 is a partial expanded plan view of the shape of the vicinity of a protruding portion of an end surface of the wheel cover in FIG. 15.

As illustrated in FIGS. 3, 15, and 16, the upper side surface 142*a* is provided with a wrap-around portion 148. The wrap-around portion 148 is provided in such a manner that the upper edge side thereof (an edge portion on the Z1 side) is continuous with the protruding portion 146. Furthermore, in the wrap-around portion 148, an angle θ formed by a tangential line A1 (may be set to a planar tangential surface A1) and a tangential line A2 (may be set to a planar tangential surface A2) in FIG. 16 is provided to become an acute angle.

In the configuration illustrated in FIG. 16, the angle formed by the tangential line A1 (tangential surface A1) and the tangential line A2 (tangential surface A2) is provided to be approximately 60 degrees. Furthermore, a line connecting the intersection between the tangential line A1 (tangential surface A1) and the tangential line A2 (tangential surface A2) to the center is a bisector A3 or approximates the bisector A3 of the angle formed by the tangential line A1 (tangential surface A1) and the tangential line A2 (tangential surface A2).

Figure 17A:
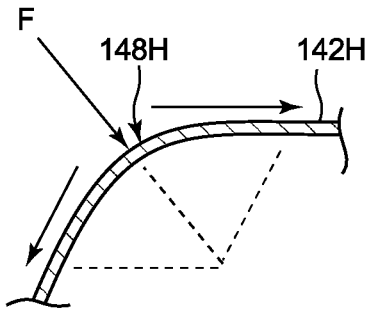
FIG. 17A is a diagram illustrating an image when a force acts on a side surface of a wheel cover according to the configuration of the related art.
Figure 17B:
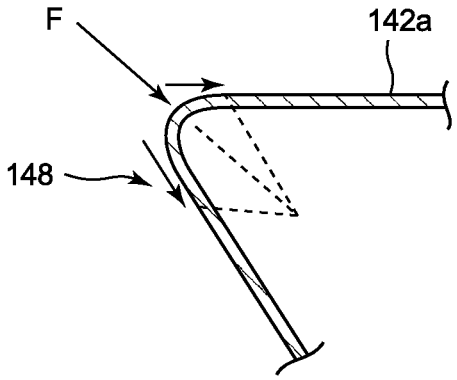
FIG. 17B is a diagram illustrating an image when a force acts on a wrap-around portion.
Figure 21:
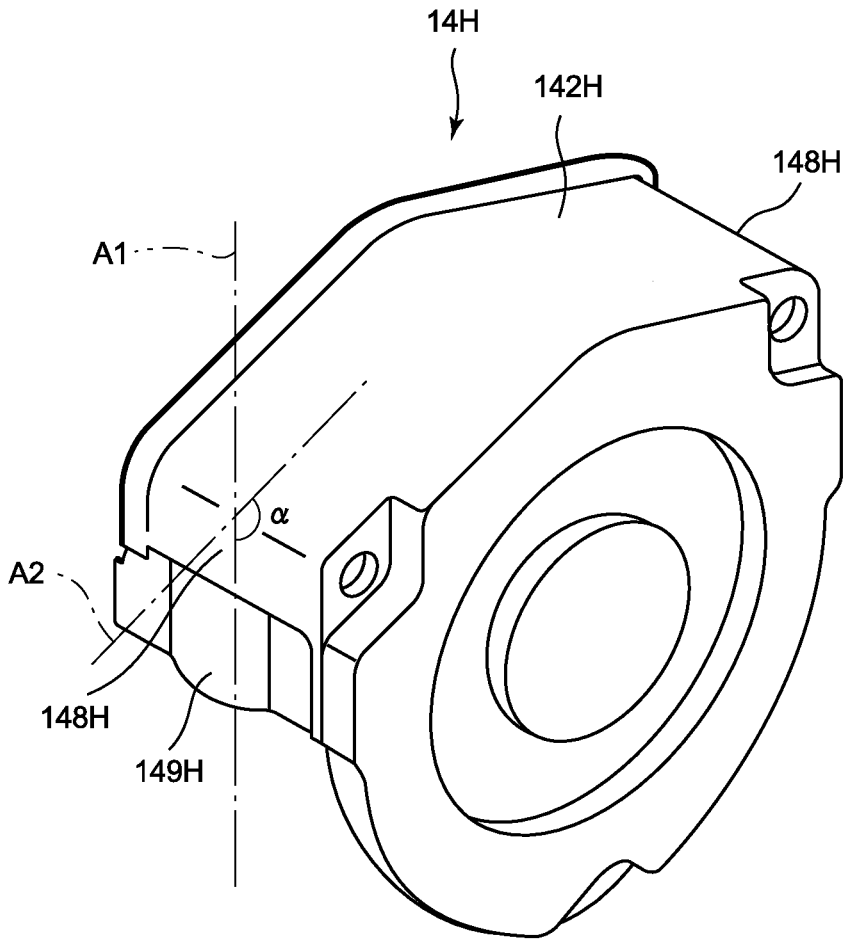
FIG. 21 is a perspective view illustrating the shape of the wheel cover according to the related art.

Here, in the wheel cover 14H according to the related art, an angle α formed by the tangential line A1 (tangential surface A1) and the tangential line A2 (tangential surface A2) in the upper side surface 142H is provided to become an obtuse angle, as illustrated in FIGS. 17A, 17B, and 21. Thus, when the wrap-around portion 148 of the wheel cover 14 according to the present embodiment is compared to the vicinity of the mounting site of the stud bolt SB of the wheel cover 14H according to the related art (a portion corresponding to the wrap-around portion 148; hereinafter referred to as a corner portion 148H), the wheel cover 14 according to the present embodiment has characteristics of larger strength.

Specifically, the corner portion 148H in the configuration illustrated in FIG. 21 is provided so as to be separated from the stud bolt SB and the bolt hole 147, compared to the wrap-around portion 148 according to the present embodiment as illustrated in FIGS. 15 and 16. Thus, when a load acts, the end surface 143 around the bolt hole 147 is easier to deform than the case where the wrap-around portion 148 according to the present embodiment exists. In contrast, in the present embodiment, the wrap-around portion 148 is positioned inside the end surface 143 and provided adjacent to the stud bolt SB and the bolt hole 147, compared to the configuration of the related art as illustrated in FIG. 21. Thus, even when a load acts on the end surface 143 around the bolt hole 147, the end surface 143 and the wrap-around portion 148 become difficult to deform.

Here, FIGS. 17A and 17B illustrate images when an external force acts on the wrap-around portion 148 and the end surface 143. A case where as illustrated in FIG. 17A, 'F' going toward the rotation center acts on a portion corresponding to the wrap-around portion 148 according to the configuration of the related art, and similarly, as illustrated in FIG. 17B, 'F' going toward the rotation center also acts on the wrap-around portion 148 according to the present embodiment is considered. As apparent from FIGS. 17A and 17B, a component of a force along the upper side surface 142*a* becomes larger in the configuration of the related art. Thereby, when the wrap-around portion 148 according to the present embodiment exists, the strength becomes larger than in the configuration of the related art as illustrated in FIGS. 17A and 21.

Furthermore, as illustrated in FIGS. 2 and 15, the wrap-around portion 148 is provided with a chain guide portion 149 in a continuous state. The chain guide portion 149 is a portion provided adjacent to the hand chain C2, and is a portion for preventing the hand chain C2 from coming off the chain pocket 82 even when the hand chain C2 significantly moves (even when the hand chain C2 "rages"). The chain guide portion 149 is provided so as to be positioned on the lower side (Z2 side) of the wrap-around portion 148, and the chain guide portion 149 has a guide bent portion 149*a*, a leg portion 149*b*, and a protruding tip 149*c*. The guide bent portion 149*a* is a portion facing the chain pocket 82 of the hand wheel 80. An end portion along the X direction of the guide bent portion 149*a* is provided facing each flange portion 80*a*.

Note that clearance between the end portion of the guide bent portion 149*a* and the flange portion 80*a* is preferably smaller than the diameter of the metal hoop C2*a* of the hand chain C2. In such a configuration, even when the hand chain C2 significantly moves (even when the hand chain C2 rages), the hand chain C2 is prevented from coming off the chain pocket 82.

Furthermore, an end portion on the X2 side of the leg portion 149*b* is provided at the same position as the flange portion 141, and an end surface of the leg portion 149*b* can abut against the second frame 12. Furthermore, the end surface of the leg portion 149*b* is provided with the protruding tip 149*c*. The protruding tip 149*c* is a portion inserted into an insertion hole 124 (refer to FIG. 14) provided in the second frame 12. By the protruding tip 149*c* inserted into the insertion hole 124, the strength of the chain guide portion 149 can be improved.

Figure 18:
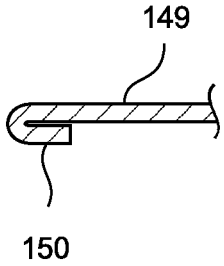
FIG. 18 is a partial cross-sectional view illustrating a configuration in the vicinity of a folded-back portion of a chain guide portion of the wheel cover in FIG. 15.

Here, as illustrated in FIG. 18, a folded-back portion 150 formed by hemming processing exists in an outer edge portion on the lower side of the chain guide portion 149. The folded-back portion 150 is provided over the entire part of the guide bent portion 149*a* and the leg portion 149*b*. Then, the existence of the folded-back portion 150 can improve the strength of the chain guide portion 149. Furthermore, the existence of the folded-back portion 150 can increase safety when a site such as hands comes in contact with the folded-back portion 150. However, the folded-back portion 150 is not necessarily provided over the entire part of the guide bent portion 149*a* and the leg portion 149*b*, and a configuration where the folded-back portion 150 does not exist in a site of at least a part of the guide bent portion and the leg portion may be employed.

<2. Regarding Action of Chain Block>

In the chain block 10 of the above-described configuration, when the hand chain C2 is operated in the winding-up direction in a state where load is hung on the lower hook 45, the hand wheel 80 rotates; however, at this time, due to the engagement of the female screw portion 81 with the male screw portion 76 of the drive shaft 70, the hand wheel 80 travels in the direction to pressurize the brake plate 92 (92*b*) (direction toward X2 in FIGS. 3 and 4) and strongly pressurizes the brake plate 92 (92*b*). Subsequently, the hand wheel 80 and the drive shaft 70 integrally rotate, and a driving force caused by the rotation is transferred to the load gear 31 through the pinion gear 72, the large-diameter gear 61, and the small-diameter gear 62 to rotate the load-sheave hollow shaft 20. Thereby, the load chain C1 is wound up and the load is lifted.

Conversely, when the lifted load is lowered, the hand chain C2 is driven in the opposite direction to when the load is lifted. Then, the hand wheel 80 releases the pressurization on the brake plate 92*b*. The drive shaft 70 rotates in the opposite direction to the winding-up direction of the load by an amount of the releasing. Thereby, the load is gradually lowered.

Note that, in a stopped state of the ratchet wheel 94, the tip of the pawl member 95 engages with the tooth portion 94*a* of the ratchet wheel 94. Moreover, even when the hands are released from the hand chain C2 at the time of winding-up to rotate the drive shaft 70 in the opposite direction by the action of gravity from the load, the brake plate 92*b* is pressed against the ratchet wheel 94 by the hand wheel 80 in a state where the hand wheel 80 does not rotate, and further the brake plate 92*a* is pressed against the flange portion 91*a* of the brake receiver 91 by the ratchet wheel 94. Thereby, a brake force resisting the gravity of the load is applied to prevent the load from being lowered.

<3. Regarding Effect>

According to the chain block 10 of the above-described configuration, the side surface 142 of the wheel cover 14 is provided with the wrap-around portion 148 illustrated in FIGS. 3, 15, and the like. Thus, due to the existence of the wrap-around portion 148, the end surface 143 around the bolt hole 147 is difficult to deform, compared to the configuration of the related art as illustrated in FIG. 21. Thereby, the strength of the wheel cover 14 can be improved.

Furthermore, when the wrap-around portion 148 exists in the wheel cover 14 as illustrated in FIG. 17B, a force acting on the upper side surface 142*a* (wrap-around portion 148) can be made small, compared to the configuration of the related art as illustrated in FIG. 17A. In addition, in the present embodiment, when an external force acts as illustrated in FIG. 17A, the existence of the wrap-around portion 148 decreases a component of the force involving flexural deformation of the upper side surface 142*a* (wrap-around portion 148), and increases a component of the force involving shear deformation of the upper side surface 142*a* (wrap-around portion 148), compared to the configuration of the related art in which the wrap-around portion 148 does not exist. Thereby, in the present embodiment, the strength of the wheel cover 14 can also be improved.

Furthermore, in the present embodiment, the chain guide portion 149 is provided adjacent to the wrap-around portion 148. Here, due to the existence of the wrap-around portion 148, a portion toward the rotation center is formed in the side surface 142 of the wheel cover 14, and thereby, the chain guide portion 149 can be integrally formed in a continuous state with the wrap-around portion 148.

Furthermore, by integrally forming the chain guide portion 149 in a continuous state with the wrap-around portion 148 in the above-described manner, a site on the wrap-around portion 148 side (a site on the upper side) of the chain guide portion 149 is supported by the wrap-around portion 148. Thereby, the strength of the chain guide portion 149 can be improved. Furthermore, when the chain guide portion 149 is integrally provided in a continuous state with the wrap-around portion 148, the number of processes when the wheel cover 14 is formed can be reduced. That is, in the configuration of the related art, as illustrated in FIG. 21, the chain guide portion 149H is separately provided, and the separate chain guide portion 149H is mounted to the wheel cover by welding. In the present embodiment, however, the wheel cover 14 and the chain guide portion 149 can be integrally formed by plastic working such as press working or deep-drawing working. Thereby, work such as welding becomes unnecessary, and the number of processes required for the welding and the like can be reduced.

Furthermore, in the present embodiment, the outer peripheral edge portion of the first frame 11 is provided with the pair of concave portions 113 passing through the center side thereof with the vertical direction (Z direction) interposed therebetween. The concave portions 113 are recessed toward the center side of the first frame 11 more than the outer peripheral edge portion of the first frame 11 adjacent to the concave portions 113. Similarly, the outer peripheral edge portion of the second frame 12 is also provided with the pair of concave portions 123 passing through the center side thereof with the vertical direction (Z direction) interposed therebetween. The concave portions 123 are recessed toward the center side of the second frame 12 more than the outer peripheral edge portion of the second frame 12 adjacent to the concave portions 123. Thus, for example, by positioning different fingers in the pair of concave portions 113 and/or the pair of concave portions 123, respectively, the chain block 10 can be grasped. That is, the chain block 10 can be grasped or held by fingers or a grasping member or holding member, using the concave portions 113, in addition to the upper hook 40, and the convenience such as carrying and storing or packing can be improved.

Further, in the present embodiment, the tip side (X2 side) spaced apart from the end surface 143 of the chain guide portion 149 is provided with the protruding tip 149*c* which is inserted into the insertion hole 124 of the second frame 12. Thus, the strength of the chain guide portion 149 can be improved. That is, when the protruding tip 149*c* is inserted into the insertion hole 124, the chain guide portion 149 is supported on the second frame 12 side. Thereby, the strength of the chain guide portion 149 can be improved.

Furthermore, in the present embodiment, the outer peripheral portion on the side spaced apart from the wrap-around portion 148 of the chain guide portion 149 (lower side; Z2 side) is provided with the folded-back portion 150 formed by hemming processing. Thus, the thickness on the lower side (Z2 side) of the chain guide portion 149 can be increased by the existence of the folded-back portion 150. In addition, the folded-back portion 150 is provided with the bent portion. Thus, when the other portions than the folded-back portion 150 of the chain guide portion 149 flexibly deform, the bent portion is shear-deformed. Thus, when the folded-back portion 150 exists, a large force becomes necessary. Thereby, the strength of the chain guide portion 149 can be improved.

Furthermore, in the present embodiment, the thickness Da2 of the tooth tip 722 of the pinion gear 72 is provided to be larger than the thickness Dc1 of the tooth tip 612 of the large-diameter gear 61. Thereby, the strength of the tooth 721 of the pinion gear 72 can be improved, and the durability of the pinion gear 72 can also be improved. That is, since the number of the teeth 721 of the pinion gear 72 is smaller than the number of the teeth 611 of the large-diameter gear 61, the teeth 721 of the pinion gear 72 are easy to wear. Thus, in the pinion gear 72H according to related art, the tooth tip 722 side of the tooth 721H is easy to break due to the wear of the tooth 721H.

However, when the thickness Da2 of the tooth tip 722 of the pinion gear 72 is made larger than the thickness Db2 of the tooth tip 722H of the pinion gear 72H according to the related art and further the thickness Da2 of the tooth tip 722 of the pinion gear 72 is made larger than the thickness Dc1 of the tooth tip 612 of the large-diameter gear 61, the durability of the tooth 721 against wear can be improved. Thereby, the lifetime of the chain block 10 can be prolonged. Furthermore, the reliability of the chain block 10 can be improved.

Furthermore, in the present embodiment, the thickness Da of the tooth 721 of the pinion gear 72 is made larger than the thickness Db according to the related art, and the thickness Dc of the tooth 611 of the large-diameter gear 61 is made smaller than the thickness Dd according to the related art. Thereby, the tooth tip 722 of the tooth 721 of the pinion gear 72 can be effectively prevented from breaking and the like.

Further, in the present embodiment, the base side (X1 side) of the pinion gear 72 is provided with the flange portion 71, and the flange portion 71 and the teeth 721 are provided in a continuous manner. Thus, the strength of each tooth 721 of the pinion gear 72 can be increased.

Further, in the present embodiment, the pair of reduction gear members 60 are provided, and the pinion gear 72 is engaged with both the pair of reduction gear members 60. Then, the pair of reduction gear members 60 are arranged at symmetrical positions with the pinion gear 72 interposed therebetween. In such a case, the teeth 721 of the pinion gear 72 wear earlier; however, even in such a case, by making the thickness Da of the tooth tip 722 large as described above, the tooth tips 722 of the teeth 721 of the pinion gear 72 can be effectively prevented from breaking and the like.

<4. Modification>

Hereinabove, the embodiment of the present invention has been described, but the present invention can be modified in various manners other than the above-described embodiment. Hereinafter, the modifications will be described.

Figure 19:
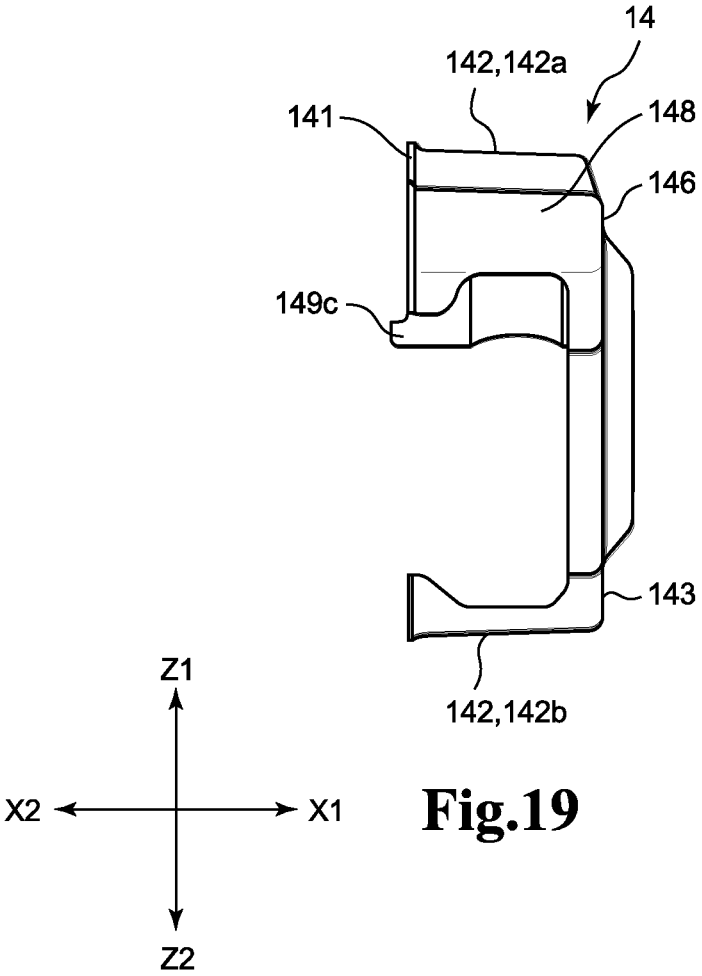
FIG. 19 is a side view illustrating the shape of a wheel cover according to a modification of the present invention.
Figure 20:
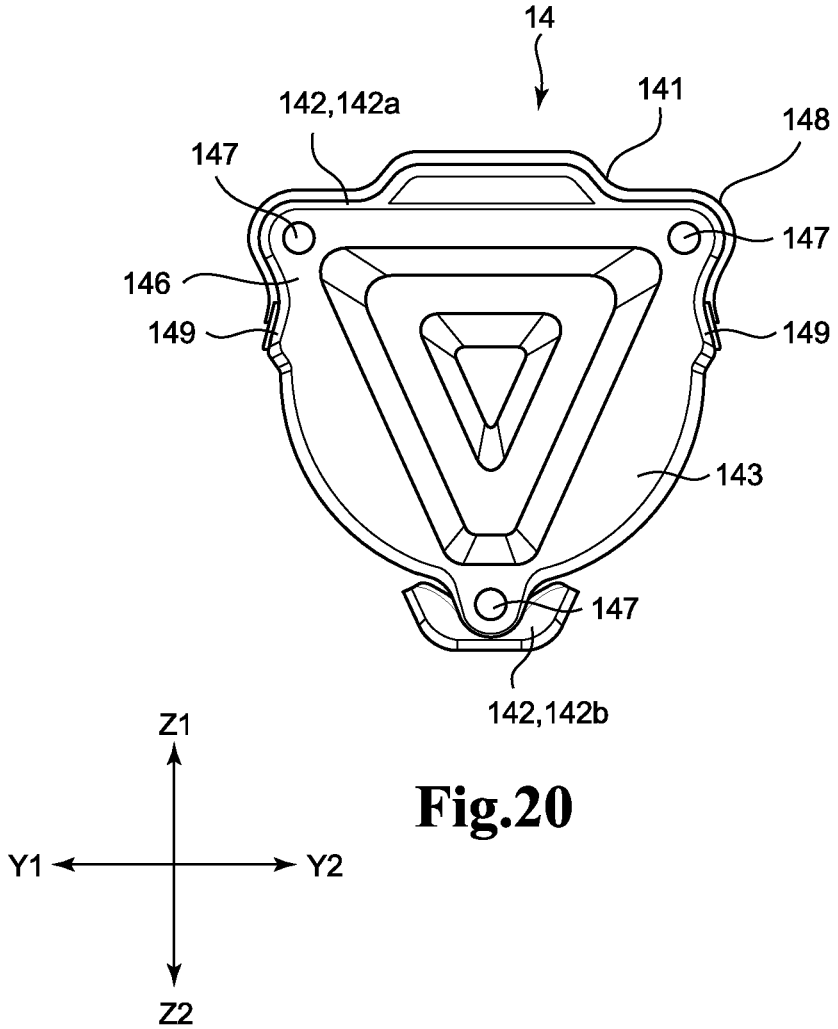
FIG. 20 is a plan view illustrating the shape of a wheel cover according to the modification of the present invention.

In the above-described embodiment, the chain guide portion 149 is integrally provided in a continuous state with the wrap-around portion 148. As illustrated in FIGS. 19 and 20, however, a configuration of separately providing chain guide portion 149 without being continuous with wrap-around portion 148 may be employed. That is, a configuration of providing the chain guide portion 149 separately from the wrap-around portion 148 by mounting the chain guide portion 149 to an end surface 143 by a technique such as welding may be employed.

In such a configuration, the degree of freedom in an arrangement position of the chain guide portion 149 with respect to the end surface 143 can be improved. Furthermore, even in such a configuration, since the wrap-around portion 148 exists in a side surface 142, the existence of the wrap-around portion 148 can improve the strength of a wheel cover 14.

Furthermore, the above-described embodiment describes the configuration of fixing the auxiliary plate 50 to the first frame 11 through the fixation hole 53 and the fixation member 55. However, for example, at least one combination of a boss hole and a boss may be used in place of the combination of the fixation hole 53 and the fixation member 55. In addition, an auxiliary plate 53 may be fixed to a first frame 11 by welding or the like.

REFERENCE SIGNS LIST

10 chain block
11 first frame
12 second frame (corresponding to frame member)
13 gear case
14 wheel cover
20 load-sheave hollow axis
23 load sheave
30 reduction member mechanism
31 load gear
31*b*, 31*b*1, 31*b*2 concave portion
40 upper hook
42 guide roller
45 lower hook
50 auxiliary plate
52 drawing portion
53 fixation hole
57 bearing hole
60 reduction gear member
61 large-diameter gear
61*a* chamfered surface portion
62 small-diameter gear
64*a* oil groove
65 swelling portion
66 recessed portion
70 diving shaft
72 pinion gear
73 inclined portion
74 curved surface portion
80 hand wheel
90 brake mechanism
91 brake receiver
92 brake plate
94 ratchet wheel
95 pawl member
110, 120 circular portion
111, 121 frame protruding portion
112, 122 insertion hole
113, 123 concave portion
124 insertion hole
141 flange portion
142 side surface
142*a* upper side surface
142*b* lower side surface
143 end surface
144 notched portion
145 left-right side surface
146 protruding portion
147 bolt hole (corresponding to fixation hole)
148 wrap-around portion
149 chain guide portion
149*a* guide bent portion
149*b* leg portion
149*c* protruding tip
150 folded-back portion
A1, A2 tangential line (tangential surface)
A3 bisector
B1 to B5 bearing
C1, C2 load chain
N nut
S space
SB stud bolt (corresponding to fixation member)

The invention claimed is:

1. A chain block comprising:

a wheel cover that is mounted to a frame member and covers a hand wheel over which a hand chain is wound, a plurality of fixation holes of the wheel cover into which fixation members are inserted during mounting to the frame member is provided in a peripheral edge portion of an end surface side of the wheel cover, which is arranged facing the frame member, and a wrap-around portion of the wheel cover formed surrounding each of the fixation holes in a continuous arcuate shape for an angle exceeding 90 degrees in a circumferential direction of the fixation hole is provided in the end surface side of the wheel cover, which intersects the end surface;

the wheel cover is provided with a chain guide portion that prevents the hand chain wounded around the hand wheel from coming off, the chain guide portion is provided adjacent to the wrap-around portion, and integrally provided in a continuous state with the wrap-around portion, the chain guide portion has a protruding tip and a guide bent portion, the protruding tip is provided on a tip side spaced apart from the end surface portion, and is inserted into an insertion hole of the frame member, the guide bent portion is provided facing a chain pocket of the hand wheel, the chain pocket of the hand wheel having a flange portion, and a clearance between the guide bent portion and the flange portion is smaller than the diameter of a metal hoop of the hand chain, a maximum width between a pair of wrap-around portions of the wheel cover is wider than a width between a pair of chain guide portions, and wider than a width between a pair of boundary portions which exist between the pair of wrap-around portions and the pair of chain guide portions, and the width between the pair of chain guide portions increases when progressing from the boundary portion in a direction away from the wrap-around portion.

2. The chain block according to claim 1, wherein an outer peripheral edge portion of the frame member is provided with at least a pair of concave portions interposed therebetween a drooping direction which passing through a center side of the frame member, the pair of concave portions being recessed toward the center side of the frame member, and the drooping direction is a direction in which the hand chain droops when used.

3. The chain block according to claim 1, wherein an outer peripheral edge portion of the frame member is provided with at least a pair of concave portions interposed therebetween a drooping direction which passing through a center side of the frame member, the pair of concave portions being recessed toward the center side of the frame member, and the drooping direction is a direction in which the hand chain droops when used.

4. The chain block according claim 1, wherein an outer peripheral edge portion of the frame member is provided with at least a pair of concave portions interposed therebetween a drooping direction which passing through a center side of the frame member, the pair of concave portions being recessed toward the center side of the frame member, and the drooping direction is a direction in which the hand chain droops when used.

5. The chain block according to claim 1, wherein an outer edge portion on a side spaced apart from the wrap-around portion of the chain guide portion is provided with a folded-back portion formed by hemming processing.

6. The chain block according to claim 1, wherein an outer edge portion on a side spaced apart from the wrap-around portion of the chain guide portion is provided with a folded-back portion formed by hemming processing.

7. The chain block according to claim 1, wherein an outer edge portion on a side spaced apart from the wrap-around portion of the chain guide portion is provided with a folded-back portion formed by hemming processing.

8. The chain block according to claim 2, wherein an outer edge portion on a side spaced apart from the wrap-around portion of the chain guide portion is provided with a folded-back portion formed by hemming processing.

9. The chain block according to claim 3, wherein an outer edge portion on a side spaced apart from the wrap-around portion of the chain guide portion is provided with a folded-back portion formed by hemming processing.

10. The chain block according to claim 4, wherein an outer edge portion on a side spaced apart from the wrap-around portion of the chain guide portion is provided with a folded-back portion formed by hemming processing.

* * * * *